US006975822B2

(12) United States Patent
Kunou et al.

(10) Patent No.: US 6,975,822 B2
(45) Date of Patent: Dec. 13, 2005

(54) RECYCLE DEVELOPER BEARING BODY, INSPECTION METHOD AND INSPECTION DEVICE THEREOF, METHOD OF RECYCLING A DEVELOPER BEARING BODY, AND METHOD OF RECYCLING A USED PROCESS CARTRIDGE

(75) Inventors: Taku Kunou, Minamiashigara (JP); Shinichiro Saito, Minaiashigara (JP); Toshiaki Murofushi, Minamiashigara (JP); Kazunari Koga, Minamiashigara (JP); Toshinori Nozaki, Asaka (JP)

(73) Assignee: Fuji Xerox Co., Ltd., Tokyo (JP)

( * ) Notice: Subject to any disclaimer, the term of this patent is extended or adjusted under 35 U.S.C. 154(b) by 36 days.

(21) Appl. No.: 10/462,787

(22) Filed: Jun. 17, 2003

(65) Prior Publication Data

US 2004/0114960 A1 Jun. 17, 2004

(30) Foreign Application Priority Data

Dec. 13, 2002 (JP) ..... 2002-363033
Dec. 13, 2002 (JP) ..... 2002-363047

(51) Int. Cl.[7] ..... G03G 15/00
(52) U.S. Cl. ..... 399/109; 29/895.1; 492/18
(58) Field of Search ..... 399/107, 109, 399/111; 430/122; 492/8, 18, 54, 58; 29/895.1

(56) References Cited

U.S. PATENT DOCUMENTS 5,781,830 A * 7/1998 Gaylord et al. ..... 399/109
6,201,942 B1 * 3/2001 Honda et al. ..... 399/286

FOREIGN PATENT DOCUMENTS

| | | |
|---|---|---|
| JP | A 7-281517 | 10/1995 |
| JP | A 8-202140 | 8/1996 |
| JP | A 9-230690 | 9/1997 |
| JP | 2001-311693 | * 11/2001 |
| JP | A 2003-29535 | 1/2003 |

* cited by examiner

*Primary Examiner*—Hoan Tran
(74) *Attorney, Agent, or Firm*—Oliff & Berridge, PLC

(57) ABSTRACT

A recycle developer bearing body which is an effective recycle of a used developer bearing body, helps effective utilization of resources, and does not result in image quality degradation, such as developer concentration unevenness. In the recycle developer bearing body, even when scars or other defects are developed on a developer bearing surface of the developer bearing body from previous use, a surface roughness Ra of the developer bearing surface having the scars or other defects of the developer bearing body is 0.8 $\mu$m or more.

11 Claims, 43 Drawing Sheets

27: DEVELOPING ROLL

46: DEVELOPING SLEEVE 49, 50: FLANGE MEMBER

47: MAGNET ROLL

48: SHAFT OF MAGNET ROLL

27: DEVELOPING ROLL

46: DEVELOPING SLEEVE 49, 50: FLANGE MEMBER

47: MAGNET ROLL

48: SHAFT OF MAGNET ROLL

3: PHOTOSENSITIVE DRUM

27: DEVELOPING ROLL

46: DEVELOPING SLEEVE 49, 50: FLANGE MEMBER

2: PROCESS CARTRIDGE

5: DEVELOPING DEVICE

28: TRACKING ROLL

FIG. 10
(A)
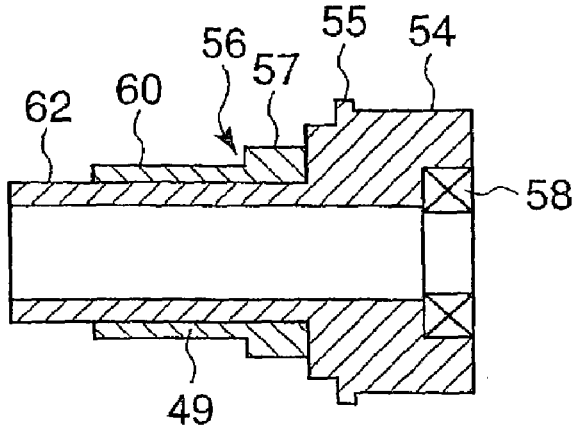
(B)
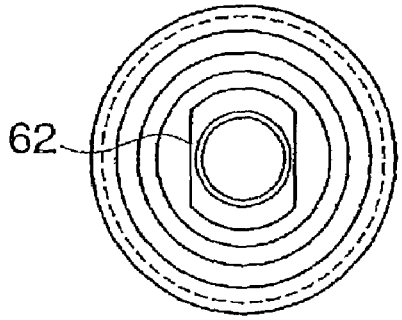

FIG. 11
(A)
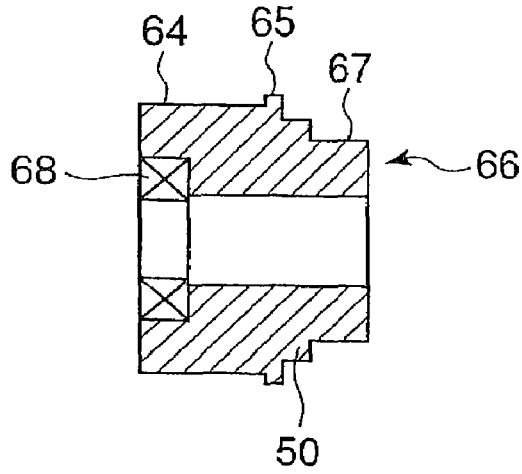
(B)
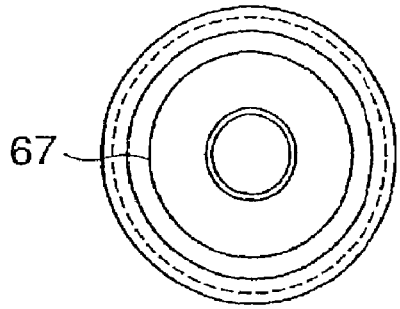

FIG. 22
(A)
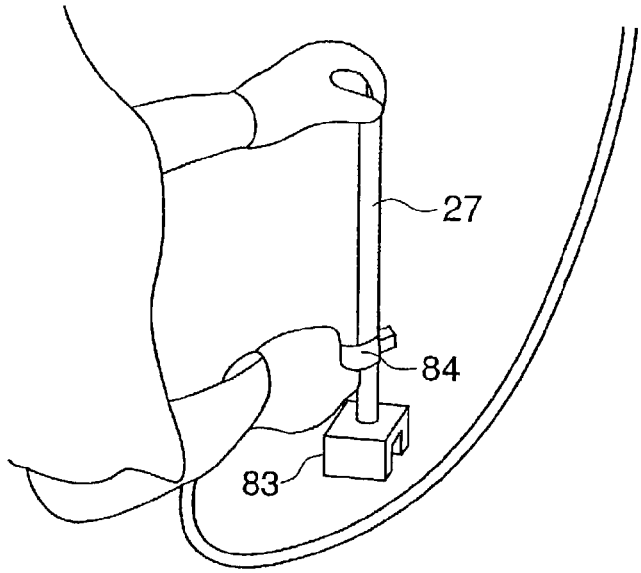
(B)
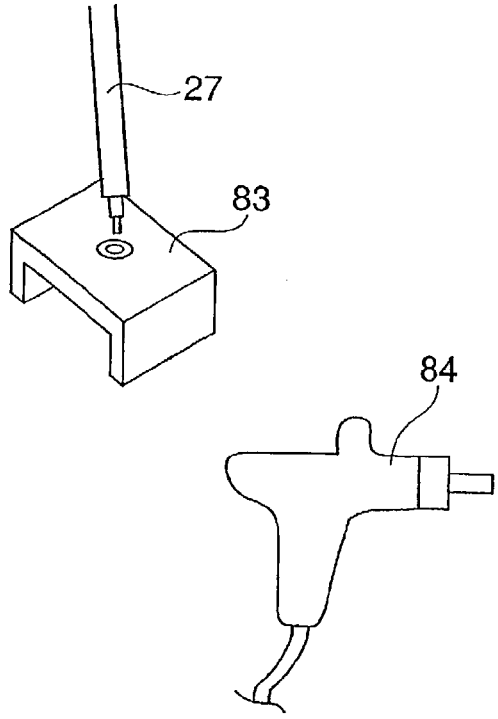

CHECK MARKING

NO MARKING → TO ONCE-RECYCLE OR BLAST RECYCLE

BLUE MARK → TO TWICE-RECYCLE

GREEN MARK → REJECTED

RED MARK → REJECTED

FIG. 26
(A)
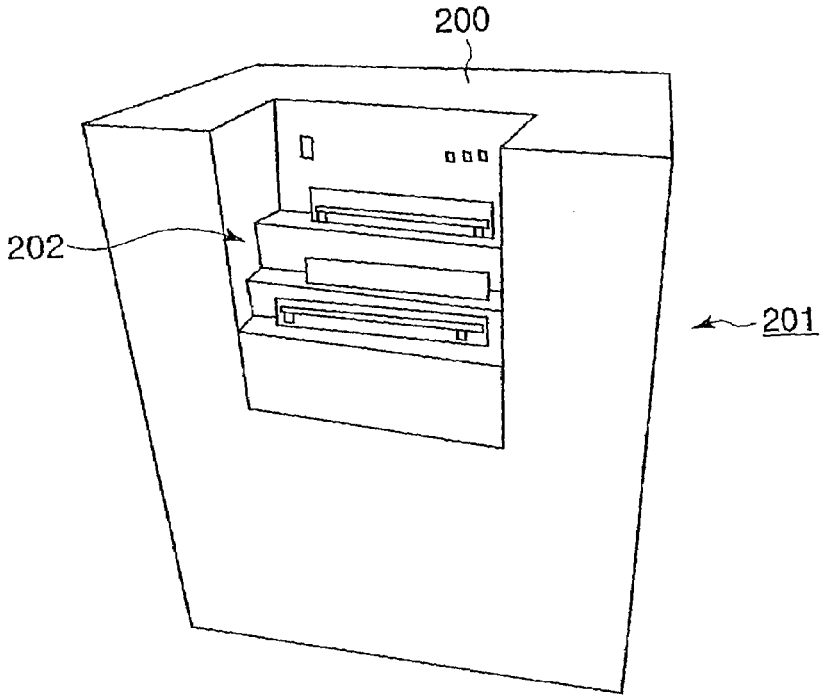
(B)
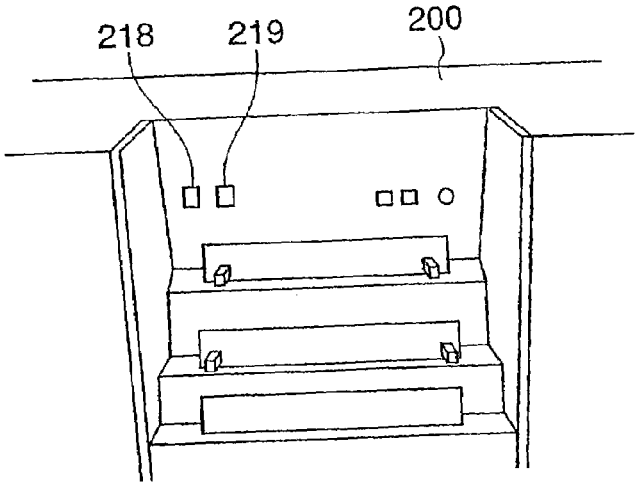

FIG. 34

MAG SLEEVE CIRCUMFERENTIAL SCAR WIDTH/SCARRED PORTION ROUGHNESS IMAGE QUALITY DEFECT PRESENCE OR ABSENCE MATRIX TABLE TO DETERMINE STANDARD FOR SORTING CIRCUMFERENTIAL SCAR

| WIDTH \ ROUGHNESS | 0 | 0.1 | 0.2 | 0.3 | 0.4 | 0.5 | 0.6 | 0.7 | 0.8 | 0.9 | 1 | 1.1 | 1.2 | 1.3 | 1.4 | 1.5 | 1.6 | 1.7 | 1.8 |
|---|---|---|---|---|---|---|---|---|---|---|---|---|---|---|---|---|---|---|---|
| 1 | | | | | | | | | | | | | | | | | | | |
| 0.95 | | | | | | | | | | | | | | | | | | | |
| 0.9 | | | | | | | ● | | | | | | | | | | | | |
| 0.85 | | | | | | | | | | | | | | | | | | | |
| 0.8 | | | | | | | | | | | | | | | | | | | |
| 0.75 | | | | | | | | | | | | | | | | | | | |
| 0.7 | | | | | | | | | | | | | | | | | | | |
| 0.65 | | | | | | | | | | | | | | | | | | | |
| 0.6 | | | | | | | ● | | | | | | | | | | | | |
| 0.55 | | | | | | | | | | | | | | | | | | | |
| 0.5 | | | | | | | | ◎ | | | | | | | | | | | |
| 0.45 | | | | | | | | | | | | | | | | | | | |
| 0.4 | | | | | | ● | | | | | | | | | | | | | |
| 0.35 | | | | | ● | | | | ● | | | | | | | | | | |
| 0.3 | | | | | | | ◎ | ◎ | | | | | | | | | | | |
| 0.25 | | | | | | | | | | ○ | | | | | | | | | |
| 0.2 | | | | | | | | | | ○ | | | | ○ | ○ | | | | |
| 0.15 | | | | | | | ○ | | | | | | | ○ | | ○ | | | |
| 0.1 | | | | | | | | ○ | | | | ○ | ○ | ○ | | ○ | | | |
| 0.05 | | | | | | | | | | | | | | | | ○ | | | |
| 0 | | | | | | | | | | | | | | | | | | | |

● NO IMAGE QUALITY PROBLEM
○ IMAGE QUALITY DEFECT OF WHITE STREAK

GRAY AREA (WIDTH ≥ 0.23 mm, ROUGHNESS ≤ 0.90 μm) IS REJECTED TO BE ON THE SAFE SIDE

USING THIS STANDARD, 500,000 SLEEVES HAVE BEEN RECYCLED AND NO TROUBLE HAS OCCURRED

FIG. 37
(A)
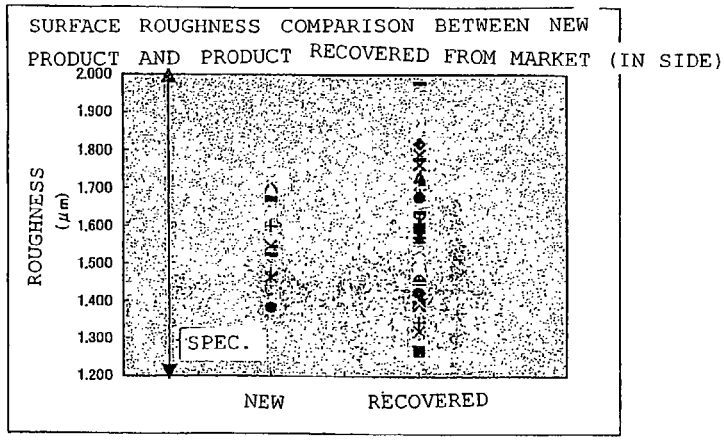
(B)
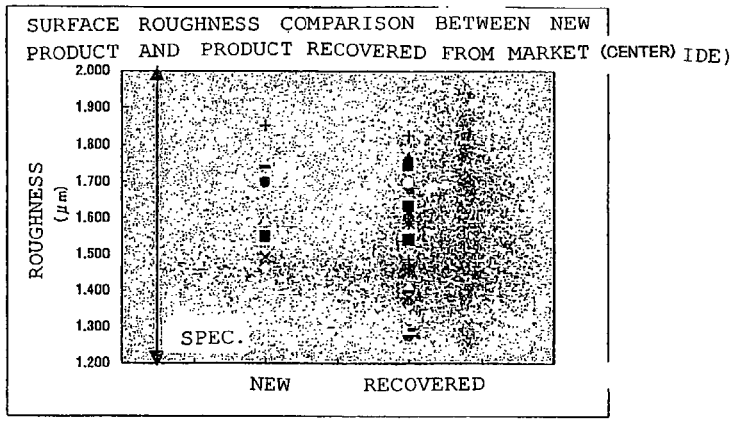
(C)
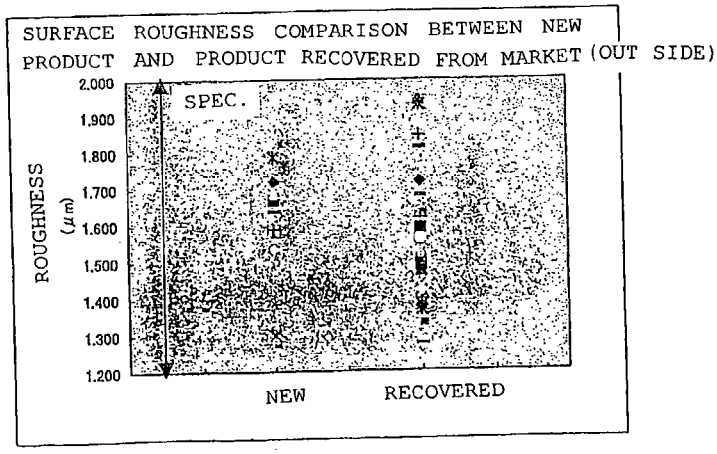

FIG. 38
(A)
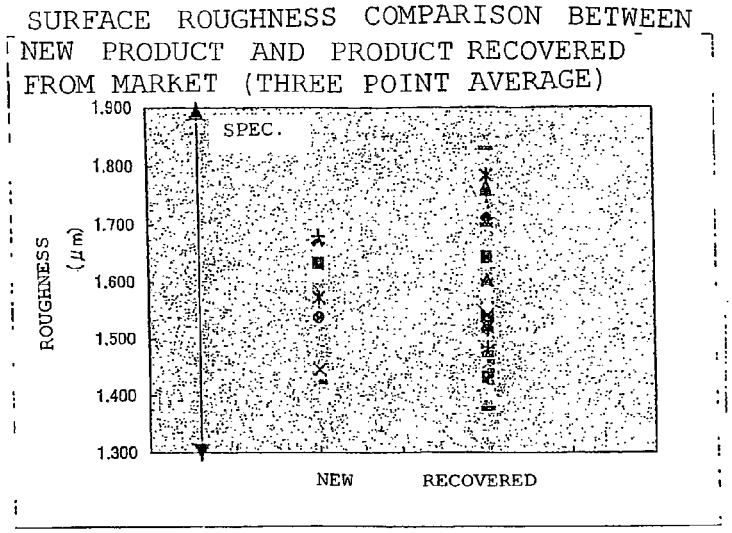
(B)
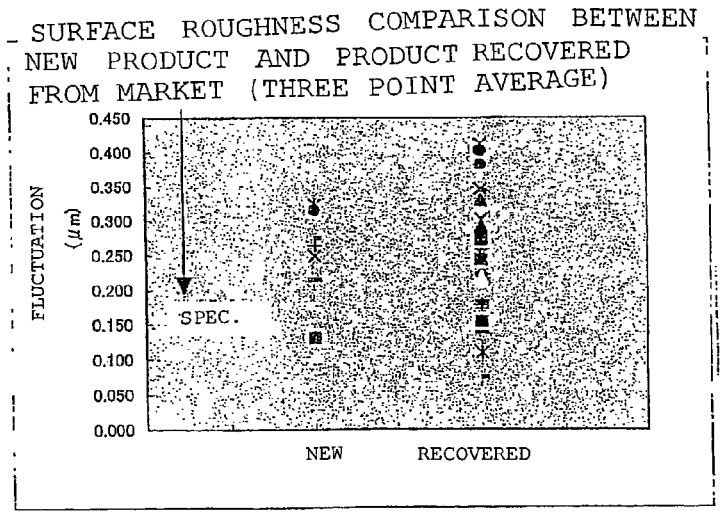
(C)
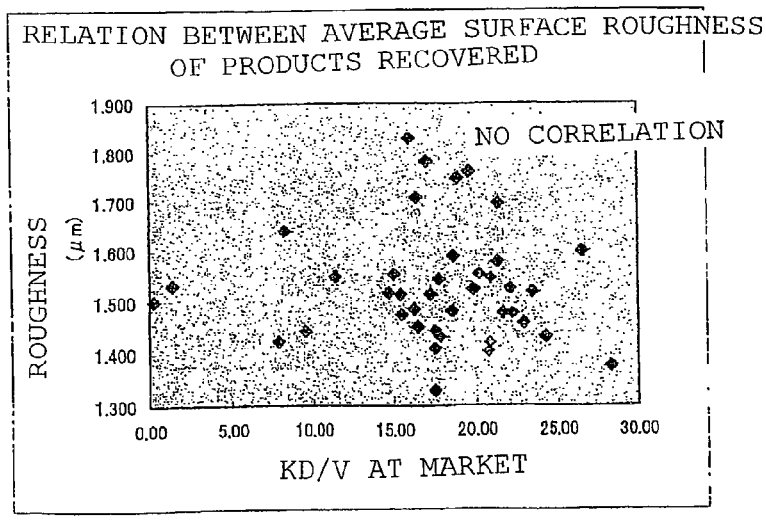

FIG. 39
(A)
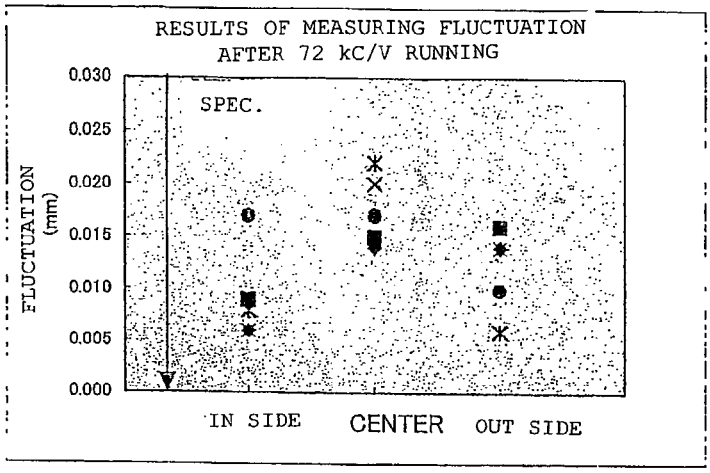
(B)
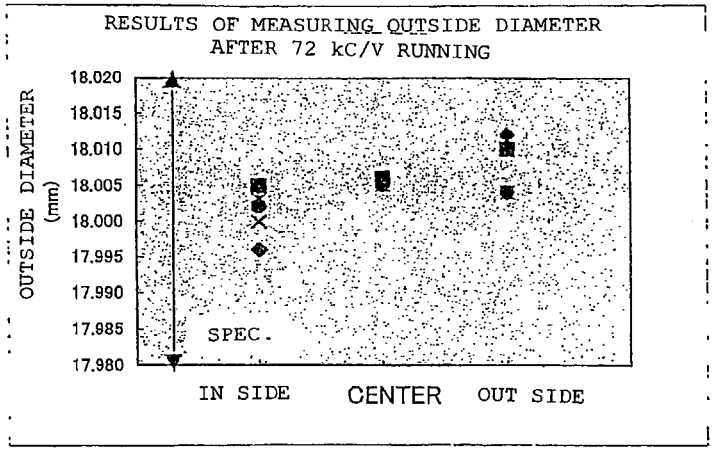
(C)
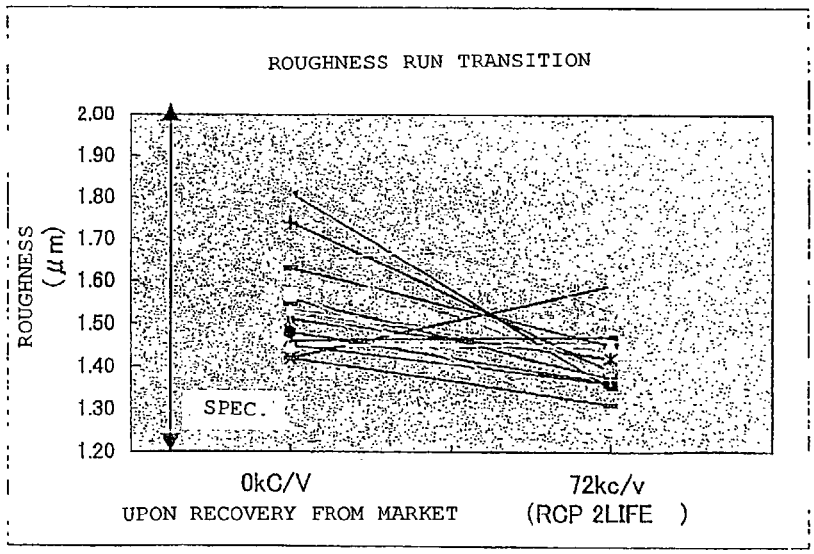

FIG. 43
(A)
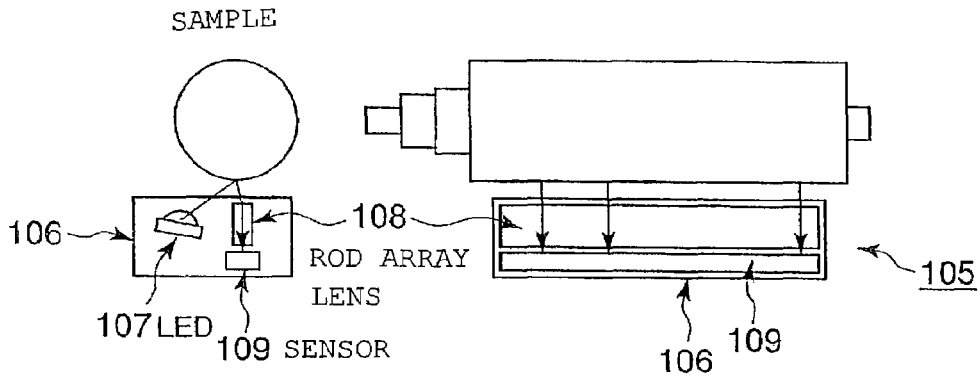
(B)
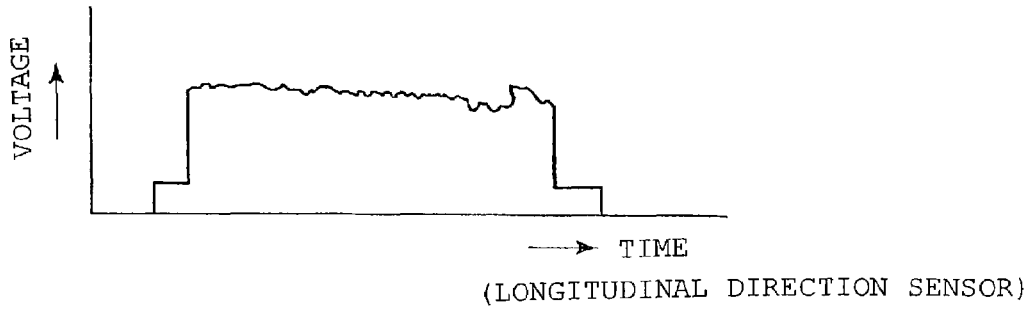

FIG. 46
(A)
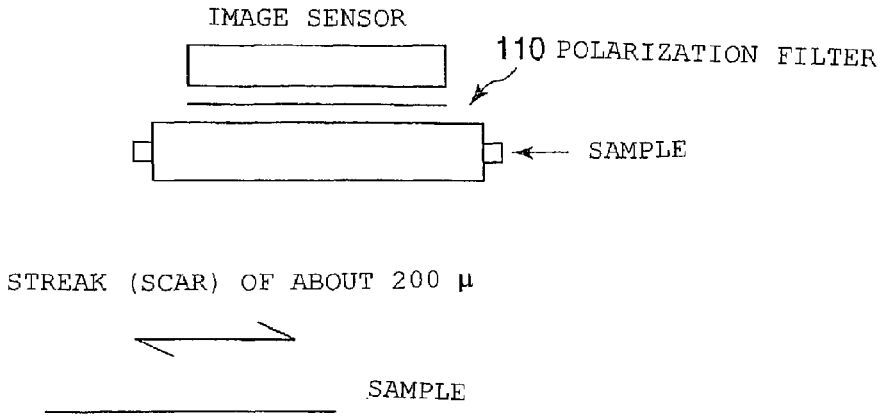
(B)
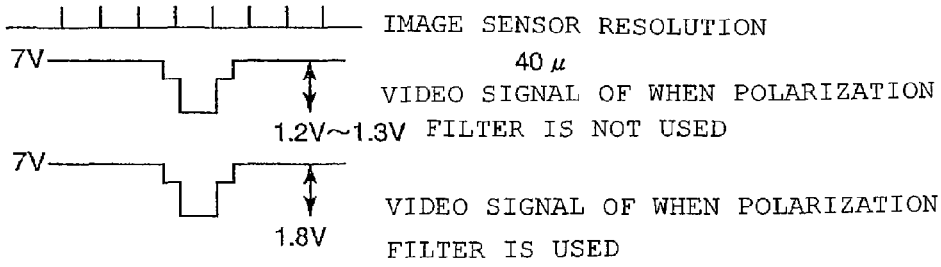
(C)
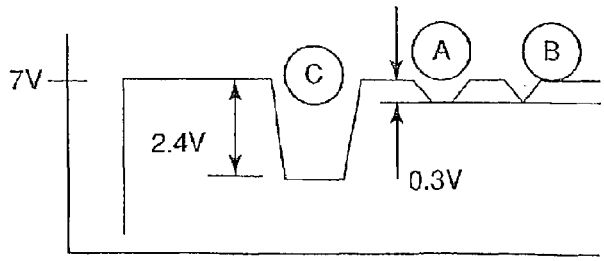

FIG. 51
(A)
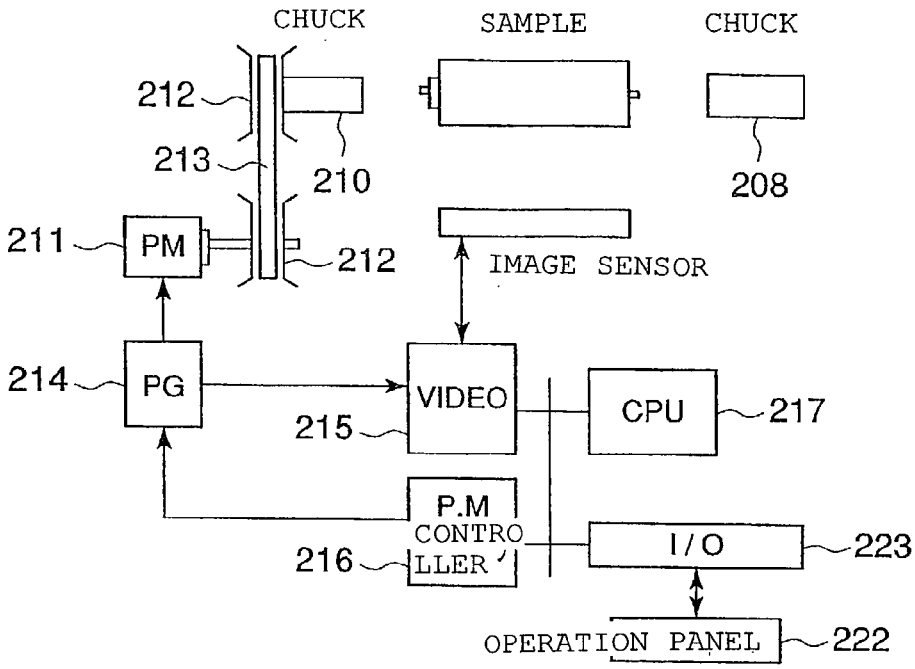
(B)
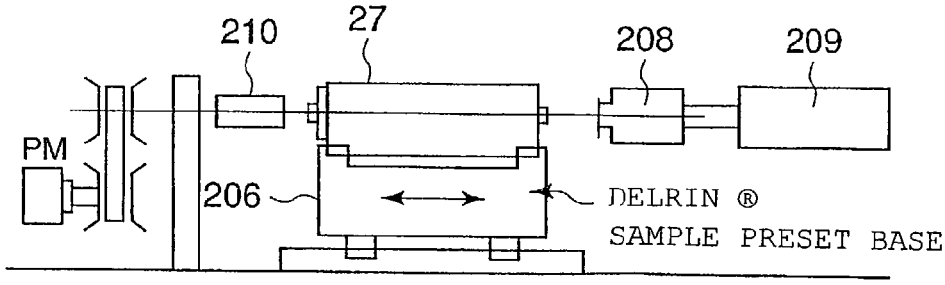

FIG. 53
(A)
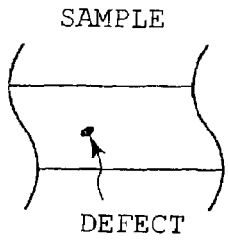
(B)
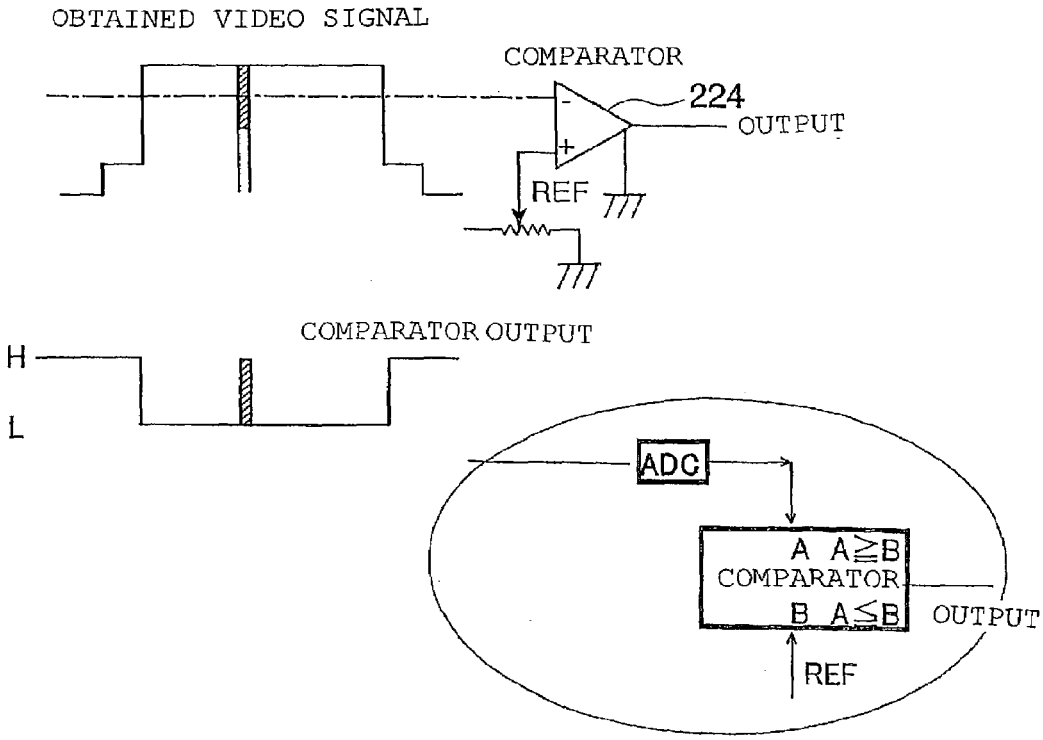

RECYCLE DEVELOPER BEARING BODY, INSPECTION METHOD AND INSPECTION DEVICE THEREOF, METHOD OF RECYCLING A DEVELOPER BEARING BODY, AND METHOD OF RECYCLING A USED PROCESS CARTRIDGE

FIELD OF THE INVENTION AND RELATED ART STATEMENT

The present invention relates to a recycle developer bearing body obtained by recovering a developer bearing body that has been used once or more as a major functional member of a developing device for use in an image forming apparatus that employs electrophotography or similar process, such as a copying machine, a laser printer, or a facsimile machine, and by performing a given test on the developer bearing body for reuse. The invention also relates to a method and device for inspecting such recycle developer bearing body, as well as a method of recycling a developer bearing body, and a method of recycling a used process cartridge.

Conventionally, the above-described developing device for use in image forming apparatus that employs electrophotography or similar process, such as a copying machine, a laser printer, or a facsimile machine, uses a developing roll which is a developer bearing body as a major functional member in order to develop an electrostatic latent image formed on a photosensitive drum that is formed of an organic photoconductor (OPC) or the like. The developing roll carries on its surface developer that contains at least toner, and rotates facing the surface of the photosensitive drum. The developer is a single component system developer composed of magnetic or non-magnetic toner alone, or a dual component system developer composed of magnetic or non-magnetic toner and carriers. If the developer bearing body is to carry magnetic, single component system developer, an aluminum or aluminum alloy cylindrical base whose surface is roughened by blast treatment is used in some cases as the developer bearing body in order to adjust the amount of developer fed.

The developer bearing body sometimes has a coated surface for the purpose of adjusting the frictional charge quantity of the developer, preventing development ghost, and the like. Examples of the coating on the surface of the developer bearing body include a resin coating disclosed in JP 09-23069 A, an inorganic plating coating whose major components are Mo (molybdenum), O and H and which is disclosed in JP 07-281517 A, and a (Ni) nickel plating coating disclosed in JP 08-202140 A.

Of the coatings given above, one is chosen based on, for example, the frictional charge characteristic of a developer to be used.

The developer bearing body structured as above is incorporated in the main body of the developing device with a flange member, a gear, or the like attached to each end, so that the developer bearing body is rotatably supported and driven rotationally. The developing device is singularly loaded in an image forming apparatus. Alternatively, the developing device is put into use after it is incorporated in a process cartridge together with a photosensitive drum and others. This makes it easy for a user to attach and detach, for replacement, the developing device to and from the main body of image forming apparatus by himself/herself.

When the developing device loaded in the image forming apparatus is in use, the developer bearing body is driven rotationally to bear developer on its surface. The amount of developer carried on the surface of the developer bearing body is kept constant by a developer regulating member. The fixed amount of developer on the surface of the developer bearing body is carried by rotation of the developer bearing body to a development position that is opposed to the surface of the photosensitive drum on which an electrostatic latent image is formed. The electrostatic latent image formed on the photosensitive drum is developed by the developer. Thereafter, the remaining developer which remains on the developer bearing body after the development is again fed to the interior of the main body of the developing device. The remaining developer is peeled off of the surface of the developer bearing body and new developer is carried on the surface of the developer bearing body for the next development process.

If, during this process, foreign objects such as paper dust and coagulated coarse developer particles gather between the developer bearing body and the regulating member of the developing device, the surface of the developer bearing body in the area clogged by the foreign objects is gradually worn away and its surface roughness is smoothed in the circumferential direction, which could cause a scar running along the circumference. The scarring of the surface of the developer bearing body is increased with time as the developing device is used longer, and can cause degradation in image quality. For that reason, a conventional developing device comes to its end as the developer initially stored in the developing device is spent. The expired developing device, or the process cartridge incorporating the expired developing device, is replaced by a new one and is discarded.

However, this is against the recent social demand, which is to recycle reusable members of image forming apparatus such as a copying machine, a printer, or a facsimile machine for waste reduction and effective utilization of resources. Developer bearing bodies too should be recovered from developing devices for reuse.

The applicant of the present invention built a resource recycling system named "Closed-loop System" in 1995 and has promoted reutilization of resources ever since with the aim of 'zero waste'. This resource recycling system is designed in view of the entire life cycle of a product, from planning, development, and manufacture to recovery and disposal of used products. Also, the applicant of the present invention has estimated items of the Closed-loop System (recovery of used products→reuse of products or turning used products into resources→manufacture by a recycle-friendly manufacture method→recycle design) by a self-developed estimation standard in order to present information on these activities to society at large. A product that meets this standard is accredited as a "resource recycling product".

The applicant of the present invention has already proposed to reuse, though not the whole developer bearing body, a magnet roll which is a component of a developer bearing body and has presented a developing roll flange member suitable for recycle of the magnet roll as well as a method of recycling a developing roll (Japanese Patent Application No. 2001-213251).

The above conventional technique has, however, the following problem:

The bottom line is that the developing roll recycling method according to Japanese Patent Application No. 2001-213251 proposed by the applicant of the present invention is intended to recycle a magnet roll which is one of components of a developer bearing body, and that the rest of the components including a developing sleeve are to be discarded. The recycling method is therefore unsatisfactory in terms of waste reduction and effective utilization of resources.

On the other hand, taking the above-described, conventional developer bearing body out of a used developing device and putting it into reuse as it is brings about the following problem:

If the surface of the developer bearing body is scarred beyond a certain extent, the scars cause developer concentration unevenness which appears as streaks and the image quality characteristic could be poorer than when a new developer bearing body is used. Accordingly, a used developer bearing body cannot be reused as it is, which hinders effective utilization of resources.

In order to avoid this problem, it is necessary to check the width and the like of scars on surfaces of used and recovered developer bearing bodies and sort them into ones that can be reused and ones that can not.

To check the width and the like of a scar on the surface of the developer bearing body and sort reusables from ones that can no longer be used, the ability of recognizing a scar on the order of 1/100 mm is required, which is beyond the naked eye. The low accuracy in visual inspection could be compensated by setting a strict sorting standard regarding whether a developer bearing body is reusable or not, but then even ones whose scars pose no threat to image quality would be rejected to lower the ratio of reusable developer bearing bodies.

Alternatively, the low accuracy in visual inspection may be compensated by magnifying a scarred area on the surface of a developer bearing body through a microscope or the like to measure the width or the like of the scar and sort reusable developer bearing bodies from ones that cannot be reused. This method, however, requires too many inspection steps and is inefficient. Furthermore, if one developer bearing body has plural scars, the required number of inspection steps is multiplied to worsen the efficiency infinitely.

OBJECT AND SUMMARY OF THE INVENTION

The present invention has been made in view of the above circumstances and provides a recycle developer bearing body which is an effective recycle of a used developer bearing body, which helps effective utilization of resources, and which has no fear of image quality degradation such as developer concentration unevenness.

The present invention also provides an inspection method and inspection device for automatically judging whether reuse of a developer bearing body causes an image quality problem or not when the developer bearing body has a scar on its surface and for picking reusable developer bearing bodies, as well as a method of recycling a developer bearing body.

According to an aspect of the present invention, a recycle developer bearing body obtained by recovering a used developer bearing body and performing a given inspection for reuse is characterized in that even when scars or other defects are developed on a developer bearing surface of the developer bearing body from previous use, a surface roughness Ra of the developer bearing surface having the scars and other defects is 0.8 $\mu$m or more.

Further, according to another aspect of the present invention, a method of inspecting a recycle developer bearing body for inspecting the surface state of a used and recovered developer bearing body for a scar or other defect with the intention of recycling is characterized in that the surface of the developer bearing body is irradiated with light, the intensity of light reflected by the developer bearing body is detected by a light receiving unit, and the surface state of the developer bearing body regarding a scar or other defect is automatically discerned based on an output signal from the light receiving unit.

Further, according to another aspect of the present invention, a recycle developer bearing body inspection device for inspecting the surface state of a used and recovered developer bearing body for a scar or other defect with the intention of recycling includes: a light radiating unit that irradiates the surface of the developer bearing body with light; a light receiving unit that receives light reflected by the developer bearing body; and a discerning unit that discerns the surface state of the developer bearing body regarding a scar or other defect based on an output signal from the light receiving unit.

Further, according to another aspect of the present invention, a method of recycling a developer bearing body for recovering a used developer bearing body for reuse includes: removing plastic parts from the used and recovered developer bearing body; cleaning the used developer bearing body from which the plastic parts are removed; irradiating with light the surface of the developer bearing body which are cleaned in the cleaning step, using a light receiving unit to detect the intensity of light reflected by the developer bearing body, and automatically discerning the surface state of the developer bearing body regarding a scar or other defect based on an output signal from the light receiving unit; removing toner that adheres to portions of the developer bearing body which has undergone the discerning step, the portions being in the vicinity of ends in the axial direction of the developer bearing body; attaching new plastic parts to the developer bearing body from which the toner is removed in the adhering toner removing step; and marking the developer bearing body to which the plastic parts are attached to indicate that the developer bearing body is a recycled product.

Further, according to another aspect of the present invention, a method of recycling a used process cartridge having a developer bearing body, comprising: disassembling the process cartridge and taking out the developer bearing body; cleaning the developer bearing body; discriminating a surface roughness Ra of the developer bearing body being 0.8 $\mu$m or more; and assembling the process cartridge using the developer bearing body discriminated by said discriminating step.

As described above, according to the present invention, a recycle developer bearing body which is an effective recycle of a used developer bearing body, which helps effective utilization of resources, and which has no fear of image quality degradation such as developer concentration unevenness can be provided.

Also, according to the present invention, an inspection method and inspection device for automatically judging whether reuse of a developer bearing body causes an image quality problem or not when the developer bearing body has a scar on its surface and for picking reusable developer bearing bodies, as well as a method of recycling a developer bearing body, and a method of recycling a used process cartridge can be provided.

BRIEF DESCRIPTION OF THE DRAWINGS

Preferred embodiment of the present invention will be described in detail based on the following figures, wherein:

FIGS. 10A and 10B are structural diagrams showing a flange member;

FIGS. 11A and 11B are structural diagrams showing a flange member;

FIGS. 22A and 22B are explanatory diagrams showing a recycling method for a recycle developer bearing body according to Embodiment 1 of the present invention;

FIGS. 26A and 26B are explanatory diagrams showing a recycling method for a recycle developer bearing body according to Embodiment 1 of the present invention;

FIG. 34 is a table showing inspection results obtained by the inspection method for a recycle developer bearing body according to Embodiment 1 of the present invention;

FIGS. 37A to 37C are graphs showing inspection results obtained by the inspection method for a recycle developer bearing body according to Embodiment 1 of the present invention;

FIGS. 38A to 38C are graphs showing inspection results obtained by the inspection method for a recycle developer bearing body according to Embodiment 1 of the present invention;

FIGS. 39A to 39C are graphs showing inspection results obtained by the inspection method for a recycle developer bearing body according to Embodiment 1 of the present invention;

FIGS. 43A and 43B are explanatory diagrams showing the operation of an inspection device for a recycle developer bearing body according to Embodiment 1 of the present invention;

FIGS. 46A to 46C are explanatory diagrams showing the operation of an inspection device for a recycle developer bearing body according to Embodiment 1 of the present invention;

FIGS. 51A and 51B are structural diagrams showing an inspection device for a recycle developer bearing body according to Embodiment 1 of the present invention;

FIGS. 53A and 53B are explanatory diagrams showing the operation of an inspection device for a recycle developer bearing body according to Embodiment 1 of the present invention;

DETAILED DESCRIPTION OF THE PREFERRED EMBODIMENT

An embodiment of the present invention will be described below with reference to the drawings.

Embodiment 1

Figure 3:
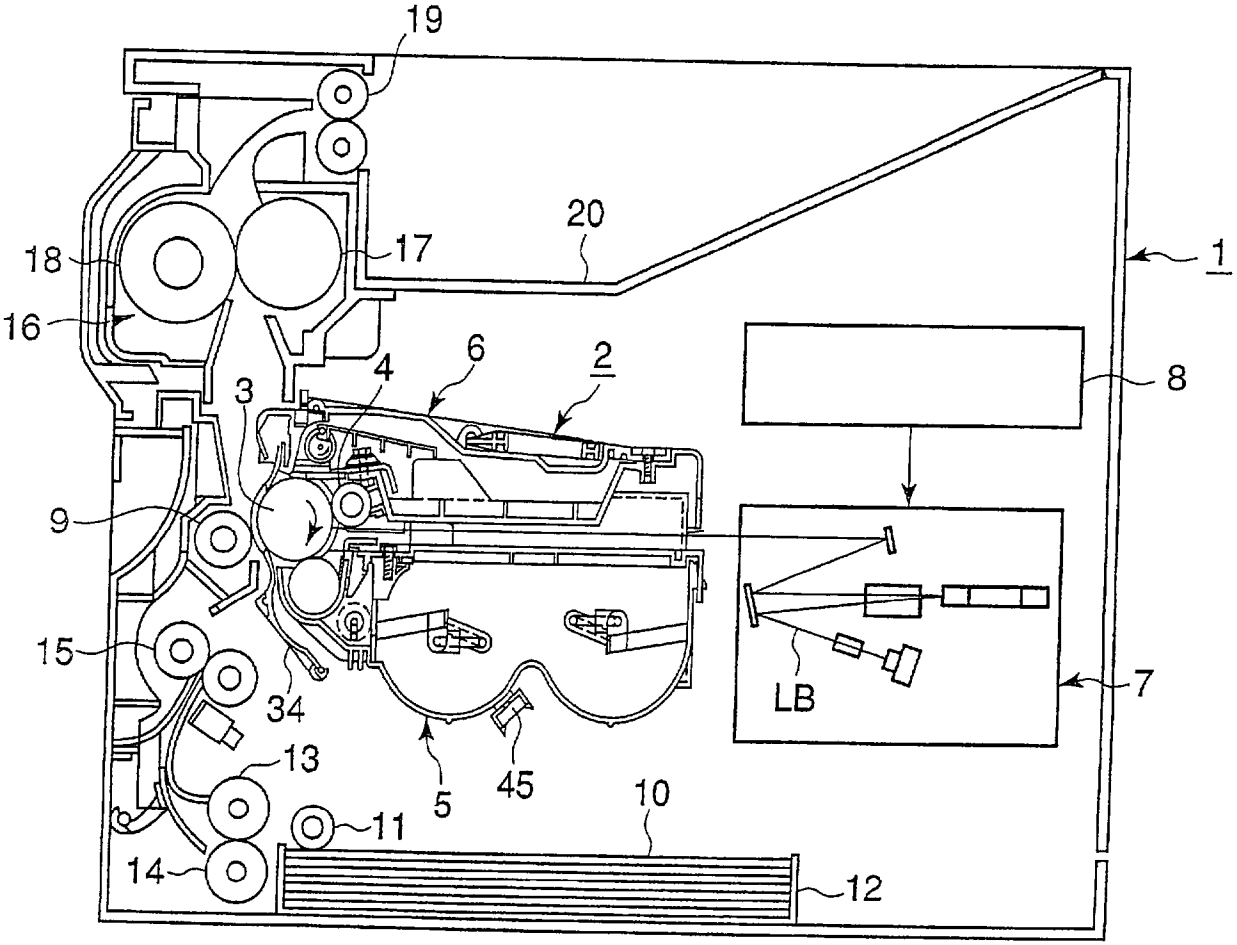
FIG. 3 is an overall structural diagram showing a digital printer as an image forming apparatus that employs the recycle developer bearing body according to Embodiment 1 of the present invention.

FIG. 3 shows a digital printer as an image forming apparatus to which a recycle developer bearing body according to Embodiment 1 of the present invention is applied.

This digital printer is structured so as to form an image from image information sent from a not-shown personal computer, image reading device, or the like. The digital printer has in its main body 1 a process cartridge 2 which is obtained by unitizing image forming members including a photosensitive drum as shown in FIG. 3. The process cartridge 2 is detachable from the printer main body 1. When a developing device is emptied of developer or a photosensitive drum or other image forming member expires, a cover in an upper part, for example, of the printer main body 1 is opened in order to replace an old process cartridge 2 with a new process cartridge 2.

Figure 4:
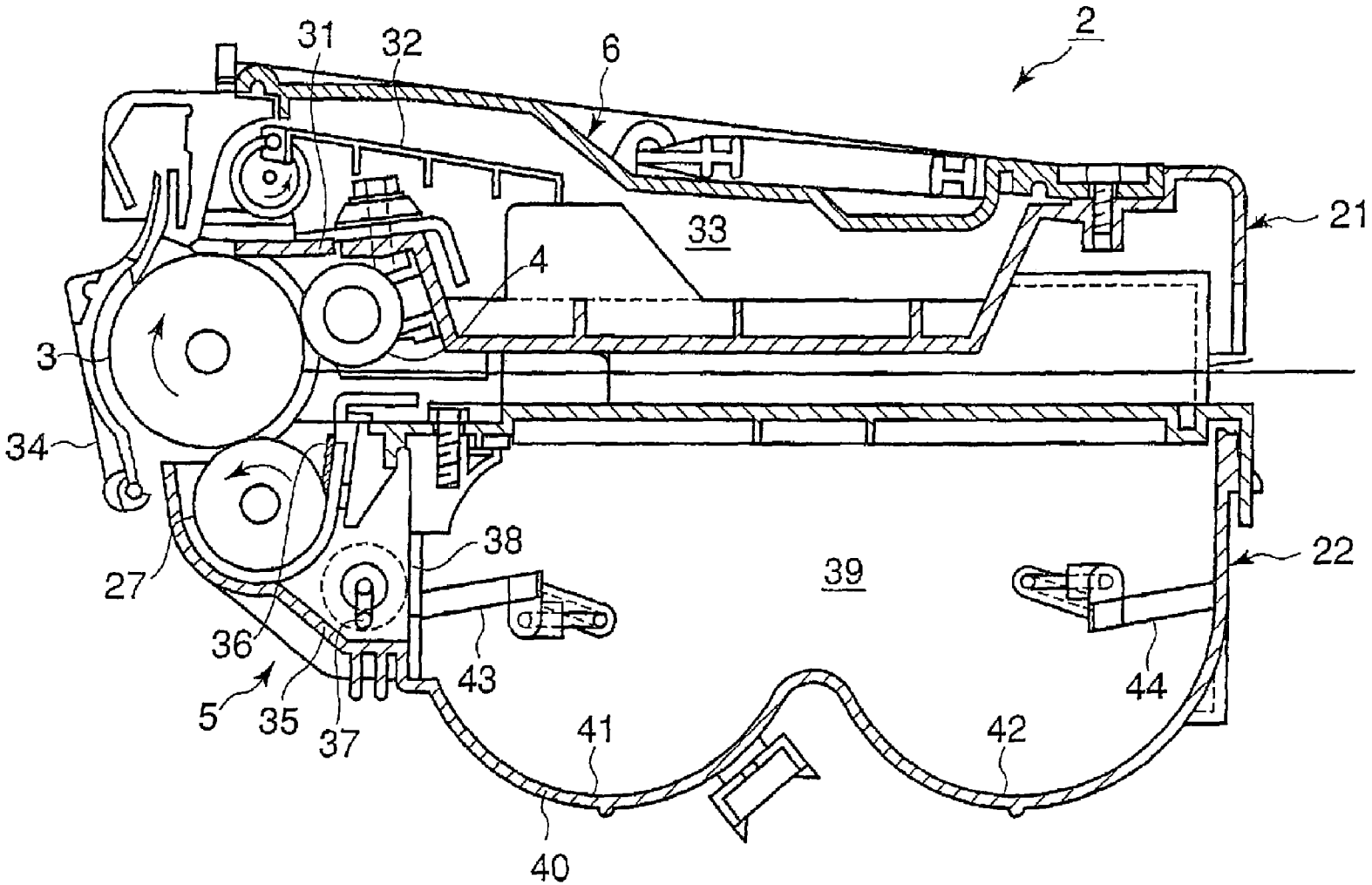
FIG. 4 is a structural diagram showing a process cartridge used in a digital printer as an image forming apparatus that employs the recycle developer bearing body according to Embodiment 1 of the present invention.

As shown in FIGS. 3 and 4, the process cartridge 2 is equipped with a photosensitive drum 3 serving as an image bearing body, a charging roll 4 serving as a charging unit, a developing device 5 serving as a developing unit, and a cleaning device 6.

A photosensitive drum formed of an organic photoconductor (OPC), for example, is used as the photosensitive drum 3. The photosensitive drum 3 is driven in the direction of the arrow at a given rotation speed by a driving unit (not shown). The surface of the photosensitive drum 3 is uniformly charged by the charging roll 4 to have a given electric potential as shown in FIG. 4. Then the surface of the photosensitive drum 3 is exposed to light for image exposure by an exposure unit, ROS (Raster Output Scanner) 7 (see FIG. 3), to form an electrostatic latent image from image information. In the ROS 7, a semiconductor laser is modulated in accordance with image information, which has received predetermined image processing in an image processing device 8 as shown in FIG. 3. A laser beam LB emitted from the semiconductor laser passes through imaging optics constituted of a collimator lens, a reflector, a polygon mirror, an f-θ lens, and the like and then runs over the photosensitive drum 3 for exposure. As a result, an electrostatic latent image is formed on the surface of the photosensitive drum 3. The electrostatic latent image formed on the photosensitive drum 3 is developed by the developing device 5 which houses single component developer (toner) to form a toner image. The developing device 5 may use dual component developer instead.

The toner image formed on the photosensitive drum 3 is, as shown in FIG. 3, transferred onto recording paper 10 which is a recording medium by a transfer roll 9 serving as a transferring unit. The recording paper 10 is fed from a sheet feeding cassette 12 by a feed roll 11. The recording paper 10 is separated from one another by a separating roll 13 and a retard roll 14 and fed one sheet at a time to the resist roll 15, where it is stopped temporarily. Then the recording paper 10 is brought by the resist roll 15 onto the surface of the photosensitive drum 3 in sync with the toner image formed on the photosensitive drum 3. The transfer roll 0 transfers the toner image from the photosensitive drum 3 onto the recording paper 10.

The recording paper 10 to which the toner image has been transferred is peeled from the photosensitive drum 3. Thereafter, the recording paper 10 is fed to a fixing device 16, where the image is fixed through heat and pressure by a heating roll 17 and pressurizing roll 18 of the fixing device 16. The recording paper 10 is then delivered by a discharge roll 19 onto a sheet delivery tray 20 which is provided in an upper part of the printer main body 1, thereby completing a series of image formation steps.

The cleaning device 6 removes residual toner on the surface of the photosensitive drum 3 after the toner image transferring step is finished, and the photosensitive drum 3 is readied for the next image formation process.

FIG. 4 shows the process cartridge of the above digital printer.

Figure 5:
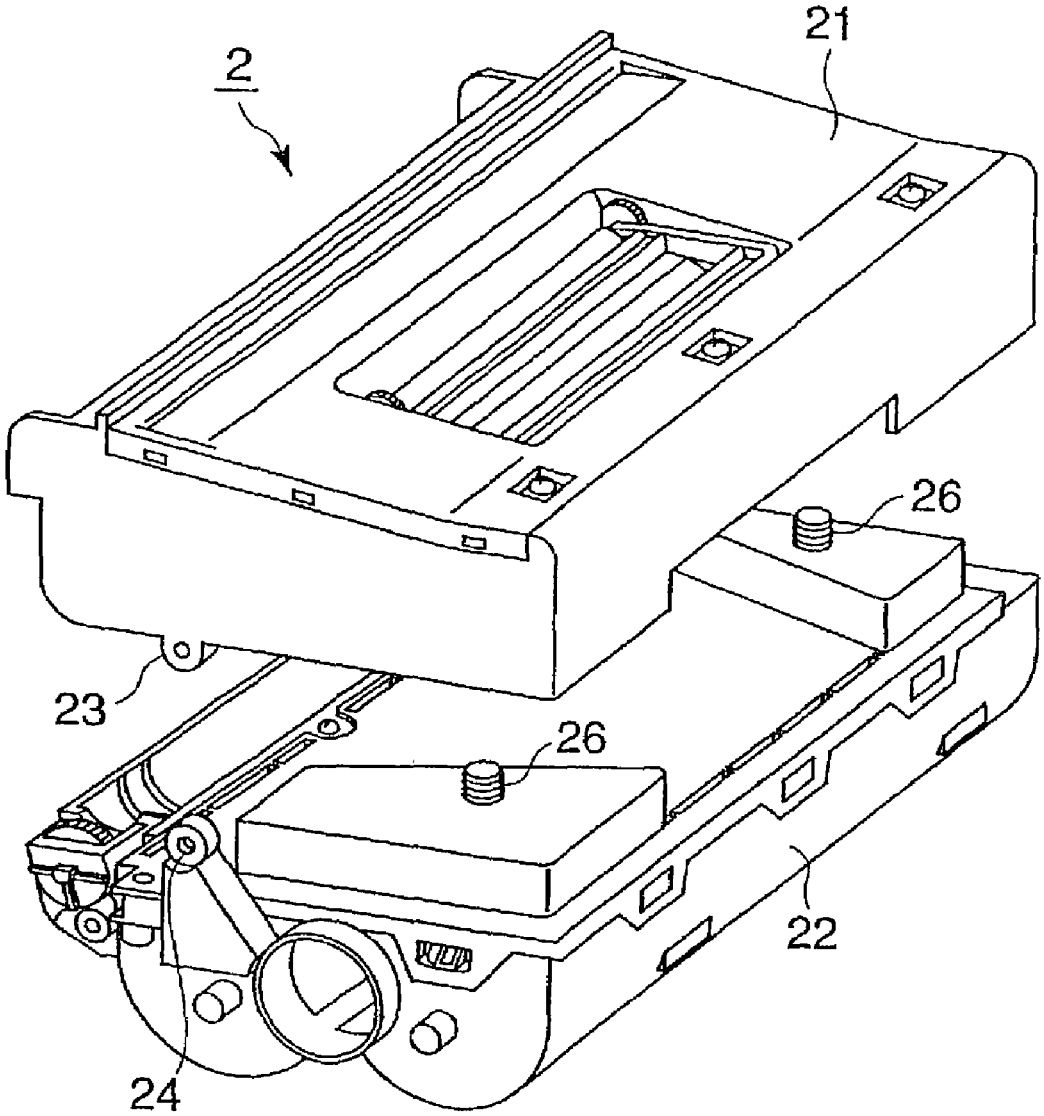
FIG. 5 is an exploded perspective view showing a process cartridge used in a digital printer as an image forming apparatus that employs the recycle developer bearing body according to Embodiment 1 of the present invention.
Figure 6:
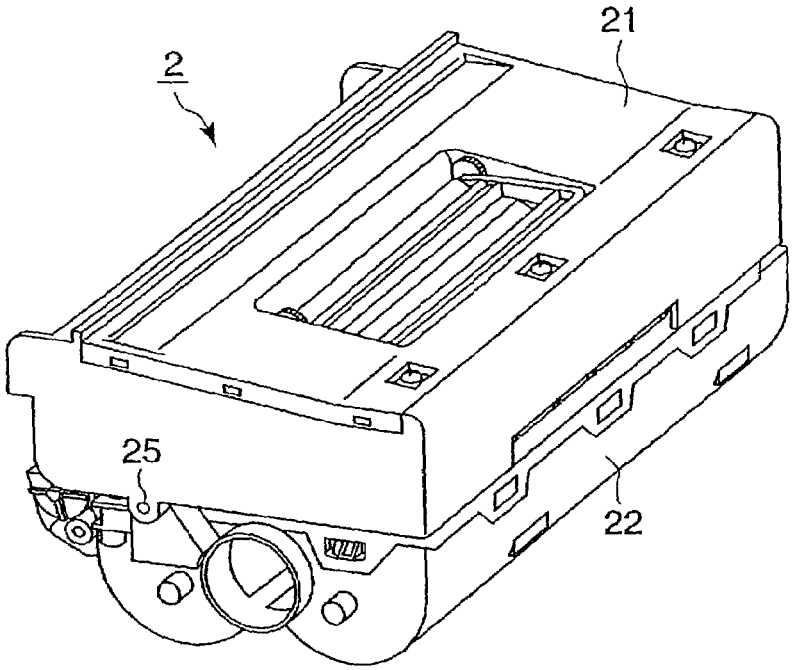
FIG. 6 is a perspective view showing a process cartridge used in a digital printer as an image forming apparatus that employs the recycle developer bearing body according to Embodiment 1 of the present invention.
Figure 7:
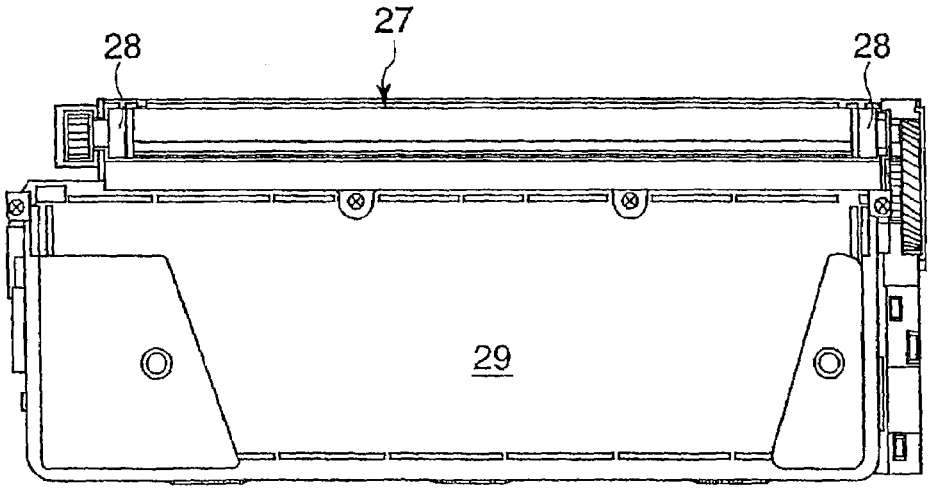
FIG. 7 is a plan view showing a part of a process cartridge used in a digital printer as an image forming apparatus that employs the recycle developer bearing body according to Embodiment 1 of the present invention.

The process cartridge 2 is composed of an upper cartridge 21 and a lower cartridge 22 as shown in FIGS. 5 and 6. Engagement portions 23 and 24 and an engagement pin 25 are provided on each end in the width direction of the upper cartridge 21 and the lower cartridge 22 to link the upper and lower cartridges in a manner that allows them to tilt about the engagement pin 25. As shown in FIG. 5, the upper cartridge 21 and the lower cartridge 22 are biased by springs 26 that are provided on the top face of the lower cartridge 22. This makes the photosensitive drum 3 pressed against a tracking roll 28 which is provided on each end of a developing roll 27 of the developing device 5 under a given pressure (for example, 2 kg on one side) as shown in FIGS. 7 and 8.

Figure 8:
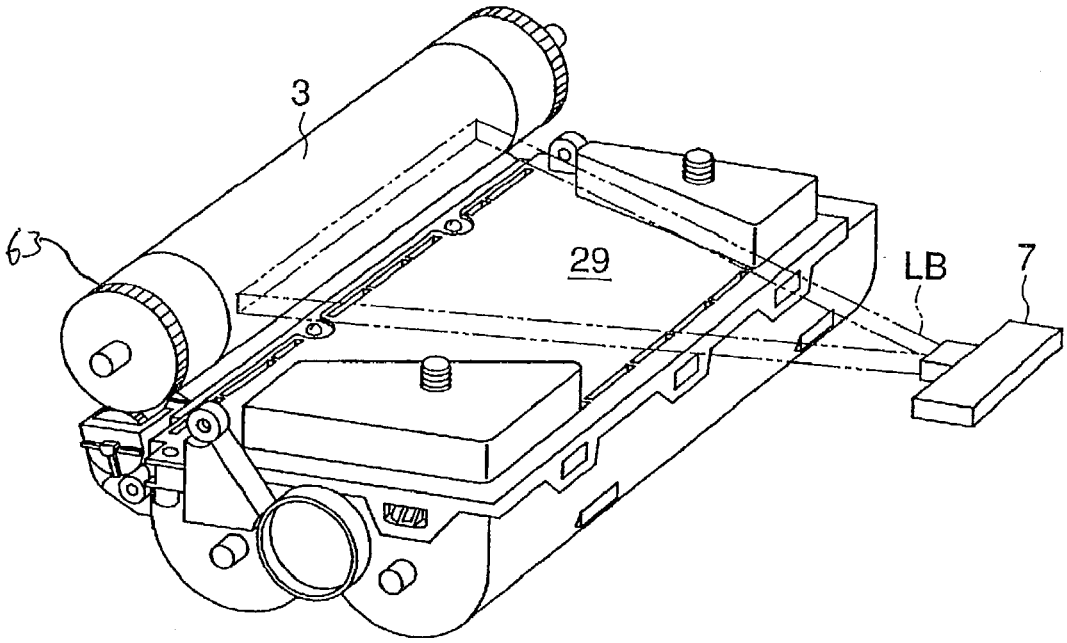
FIG. 8 is a perspective view showing a part of a process cartridge used in a digital printer as an image forming apparatus that employs the recycle developer bearing body according to Embodiment 1 of the present invention.

As shown in FIG. 8, a substantially fan-shaped irradiation space 29 for exposing the surface of the photosensitive drum 3 to the laser beam LB projected from the ROS 7 is provided on the top face of the lower cartridge 22.

The photosensitive drum 3 is rotatably attached to one end of the upper cartridge 21 as shown in FIG. 4. The charging roll 4 is located to a side of the photosensitive drum 3. A cleaning blade 31 of the cleaning device 6 is placed above the photosensitive drum 3. The cleaning device 6 is equipped with a recovered toner feeding member 32 and a recovered toner receptacle 33. The recovered toner feeding member 32 transports recovered toner which has been removed by the cleaning blade 31. The recovered toner receptacle 33 receives recovered toner that the recovered toner feeding member 32 transports, and takes up most spaces of the upper cartridge 21. The upper cartridge 21 also has a cover 34 which covers the surface of the photosensitive drum 3 but can be opened. The cover 34 usually covers the surface of the photosensitive drum 3 as shown in FIG. 4 to protect the photosensitive drum 3 against exposure to light and resultant degradation. When the process cartridge 2 is loaded in the printer body 1 at a given position, the cover 34 is automatically opened accompanying the loading operation and comes into contact with the transfer roll 9.

The lower cartridge 22 constitutes the developing device 5. The developing roll 27 is rotatably placed on one end of a housing 35 of the developing device 5. A layer thickness regulating member 36 abuts the surface of the developing roll 27 for frictional charging of toner and regulation of the thickness of a toner layer. On the back side of the developing roll 27, a toner supplying member 37 is rotatably provided to supply toner to the surface of the developing roll 27. An integral toner receptacle 39 is placed on the back side of the toner supplying member 37 with a toner supplying opening 38 interposed therebetween. The toner receptacle 39 takes up most spaces of the developing device 5. A bottom face 40 of the toner receptacle 39 is shaped like two joined arcs in section by joining portions 41 and 42. Toner stirring and feeding members 43 and 44 are rotatably set in the toner receptacle 39 to sequentially feed toner from the second toner receptacle portion 42 in the back to the first toner receptacle portion 41 on the side of the developing roll 27 while stirring the contained toner.

A toner sensor 45 for detecting the presence or absence of toner is provided on the bottom face of the first toner receptacle portion 41 as shown in FIG. 3.

Figure 1:
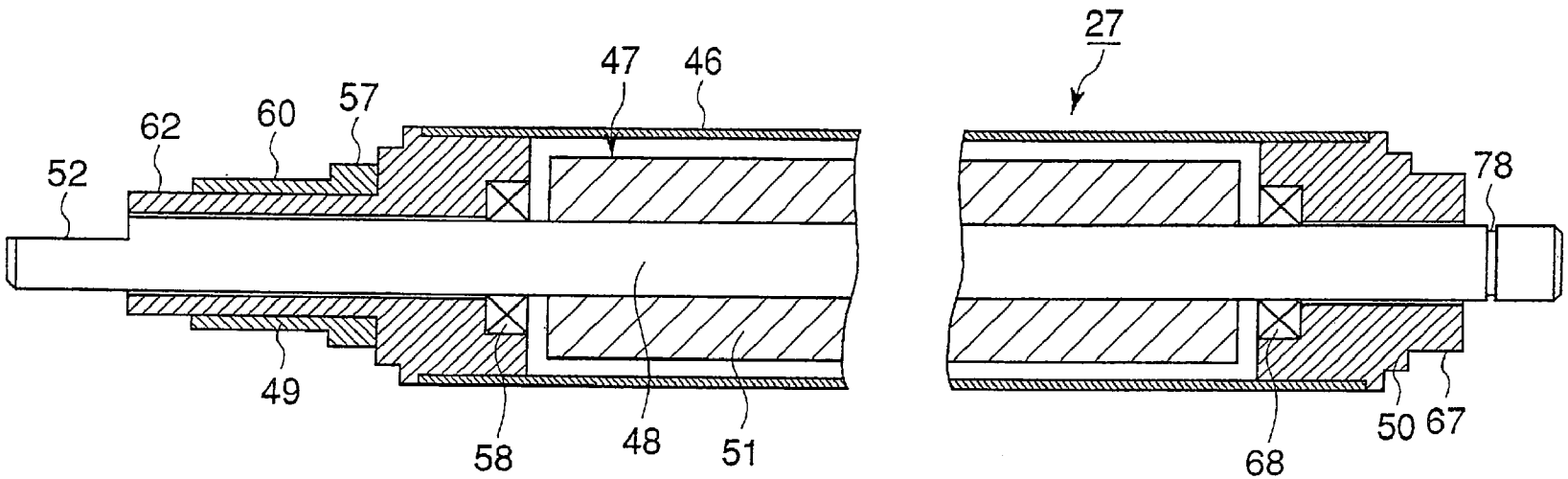
FIG. 1 is a sectional view of a developing roll as a recycle developer bearing body according to Embodiment 1 of the present invention.

FIG. 1 is a sectional view showing a developing roll which is a developer bearing body according to Embodiment 1 and which is used in the above developing device.

Figure 9:
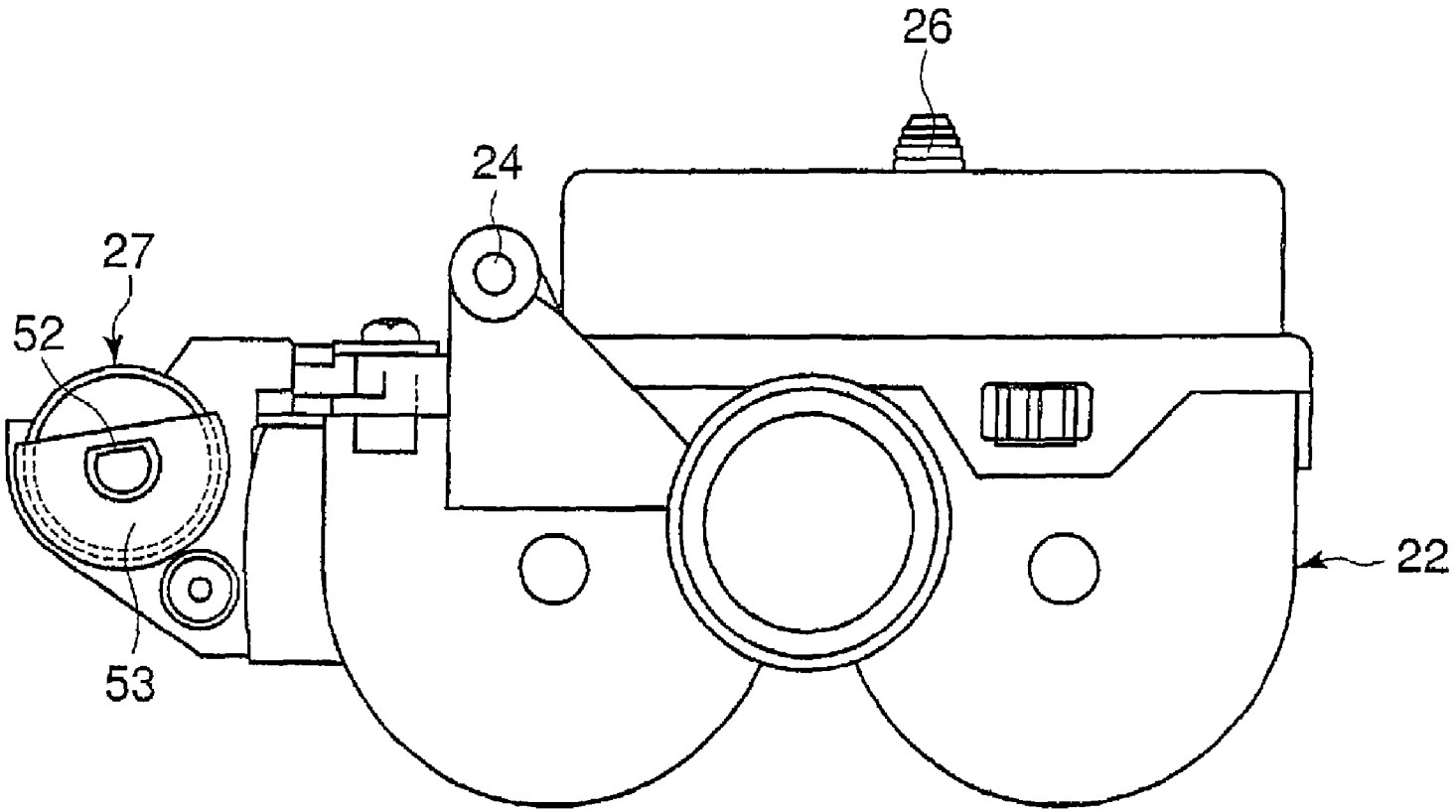
FIG. 9 is a side view showing a part of a process cartridge used in a digital printer as an image forming apparatus that employs the recycle developer bearing body according to Embodiment 1 of the present invention.

The developing roll 27 as the developer bearing body has, as shown in FIG. 1, a developing sleeve 46 formed into a cylinder from a non-magnetic metal material such as non-magnetic SUS, aluminum, or an aluminum alloy; a magnet roll 47 fixedly placed in the developing sleeve 46; and flange members 49 and 50 for rotatably attaching the developing sleeve 46 to a shaft 48 which is an axial member of the magnet roll 47. The magnet roll 47 is obtained by forming a magnetic material 51 into a cylinder and fixing the cylinder integrally to the circumference of the metal shaft 48. The magnetic material 51 has at a given point along the circumference of its cylindrical shape a magnetic pole of a given polarity. The metal shaft 48 has on one end a D-cut portion 52 which is cut to have a D shape in section, so that the magnetic material 51 is attached at a given angle to the one end. As shown in FIG. 9, the metal shaft 48 is attached to one side face 53 of the lower cartridge 22 by fitting the D-cut portion 52 into 53 and turning until it comes to a stop.

The developing roll 27 is, for example, an aluminum or aluminum alloy developing sleeve 46 whose surface is roughened by blast treatment in order to adjust the amount of developer fed. The developing sleeve 46 employed has a coated surface for the purpose of adjusting the frictional charge quantity of the developer, preventing development ghost, and the like. Examples of the coating on the surface of the developing sleeve 46 include a resin coating disclosed in JP 09-23069 A, an inorganic plating coating whose major components are Mo (molybdenum), O and H and which is disclosed in JP 07-281517 A, and a (Ni) nickel plating coating disclosed in JP 08-202140 A.

FIGS. 10A and 10B and 11A and 11B are structural diagrams each showing different flange members that are used in the above developing roll.

The developing roll flange members 49 and 50 are formed of, for example, a metal such as stainless steel or aluminum. Of the developing roll flange members 49 and 50, the flange member 49 that is placed on the OUT side (near side) of the device is shaped like a tapered cylinder as shown in FIGS. 10A and 10B. A fitted portion 54 which is to be fitted into the developing sleeve 46 and fixed therein with an adhesive is placed on an inner end of the flange member 49. A stopper wall 55 against which an end of the developing sleeve 46 collides protrudes radially outward from the outer face of the fitted portion 54 to form a ring. The height of the stopper wall 55 is equal to or somewhat smaller than the thickness of the developing sleeve 46.

A supporting portion 57 which has a given outer diameter and which is within a given allowance is formed outside of the stopper wall 55 of the flange member 49 on the circumference of the cylindrical portion 56 as a protrusion portion. The supporting portion 57 rotatably supports the tracking roll 28 which serves as a gap setting member for setting the gap between the developing sleeve 46 and the photosensitive drum 3 to a given value. The flange member 49 is rotatably and axially supported by the bearing member 58 to the shaft 48 of the magnet roll 47. The inside diameter of the flange member 49 excluding the bearing member 58 is set such that no other portions of the flange member 49 than the bearing member 58 are in contact with the magnet roll 47.

As shown in FIGS. 10A and 10B, the cylindrical portion 56 of the flange member 49 has on its outer face an attachment portion 60, which is to be attached to the housing 35 of the developing device 5 provided in the process cartridge 2 through a bearing member 59 (see FIG. 2) for rotatably supporting the developing roll 27.

The flange member 49 has on its outer end a driving portion 62 to which a gear 61 for rotationally driving the developing sleeve 46 is attached as shown in FIGS. 10A and 10B. The driving portion 62 is shaped like a double D, so that the gear 61 is attached by turning the gear 61 until it comes to a stop. The gear 61 attached to an end of the flange member 49 meshes with a drive gear 63 which is provided on one end of the photosensitive drum 3 as shown in FIGS. 2 and 8.

Of the developing roll flange members 49 and 50, the flange member 50 that is placed on the IN side (back side) of the device is shaped like a relatively short cylinder as shown in FIGS. 11A and 11B. A fitted portion 64 which is to be fitted into the developing sleeve 46 and fixed therein with an adhesive is placed on an end portion of the flange member 50. A stopper wall 65 against which an end of the developing sleeve 46 collides protrudes radially outward from the outer end portion of the fitted portion 64 to form a ring. The height of the stopper wall 65 is equal to or somewhat smaller than the thickness of the developing sleeve 46.

A supporting portion 67 which has a given outer diameter and which is within a given allowance is formed outside of the stopper wall 65 of the flange member 50 on the circumference of the cylindrical portion 66. The supporting portion 67 rotatably supports the tracking roll 28 which serves as a gap setting member for setting the gap between the developing sleeve 46 and the photosensitive drum 3 to a given value. A bearing member 68 for rotatably attaching the flange member 50 to the shaft 48 of the magnet roll 47 is provided on the inner circumference of the fitted portion 64 of the flange member 50. The flange member 50 is rotatably and axially supported by the bearing member 68 to the shaft 48 of the magnet roll 47. The inside diameter of the flange member 50 excluding the bearing member 68 is set such that no other portions of the flange member 50 than the bearing member 68 are in contact with the magnet roll 47.

Figure 2:
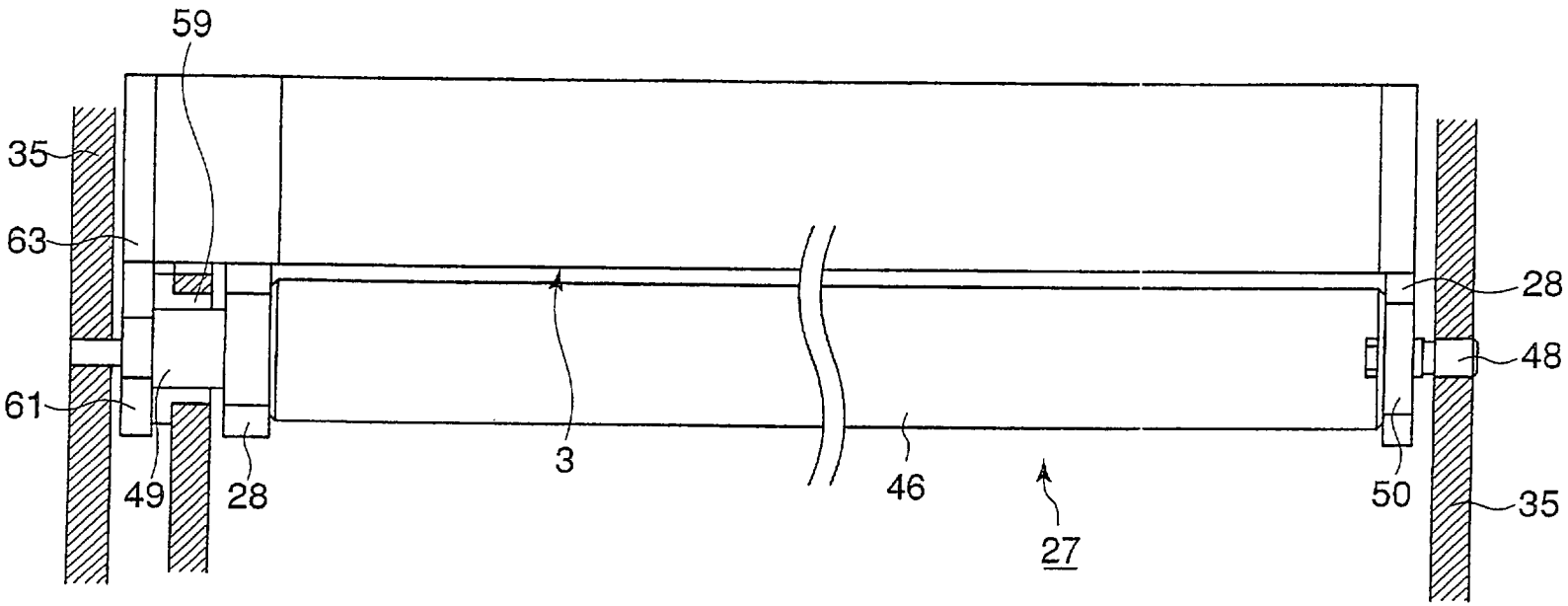
FIG. 2 is a structural diagram showing a developing roll in use which is the recycle developer bearing body according to Embodiment 1 of the present invention.

As shown in FIG. 2, in the flange member 50, the tracking roll 28 rotatably supported to the supporting portion 67 of the flange member 59 abuts the photosensitive drum 3 on the surface. The shaft 48 of the magnet roll 47 to which the flange member 50 is rotatably and axially supported is attached to the housing 35 of the developing device 5 provided in the process cartridge 2.

Figure 12:
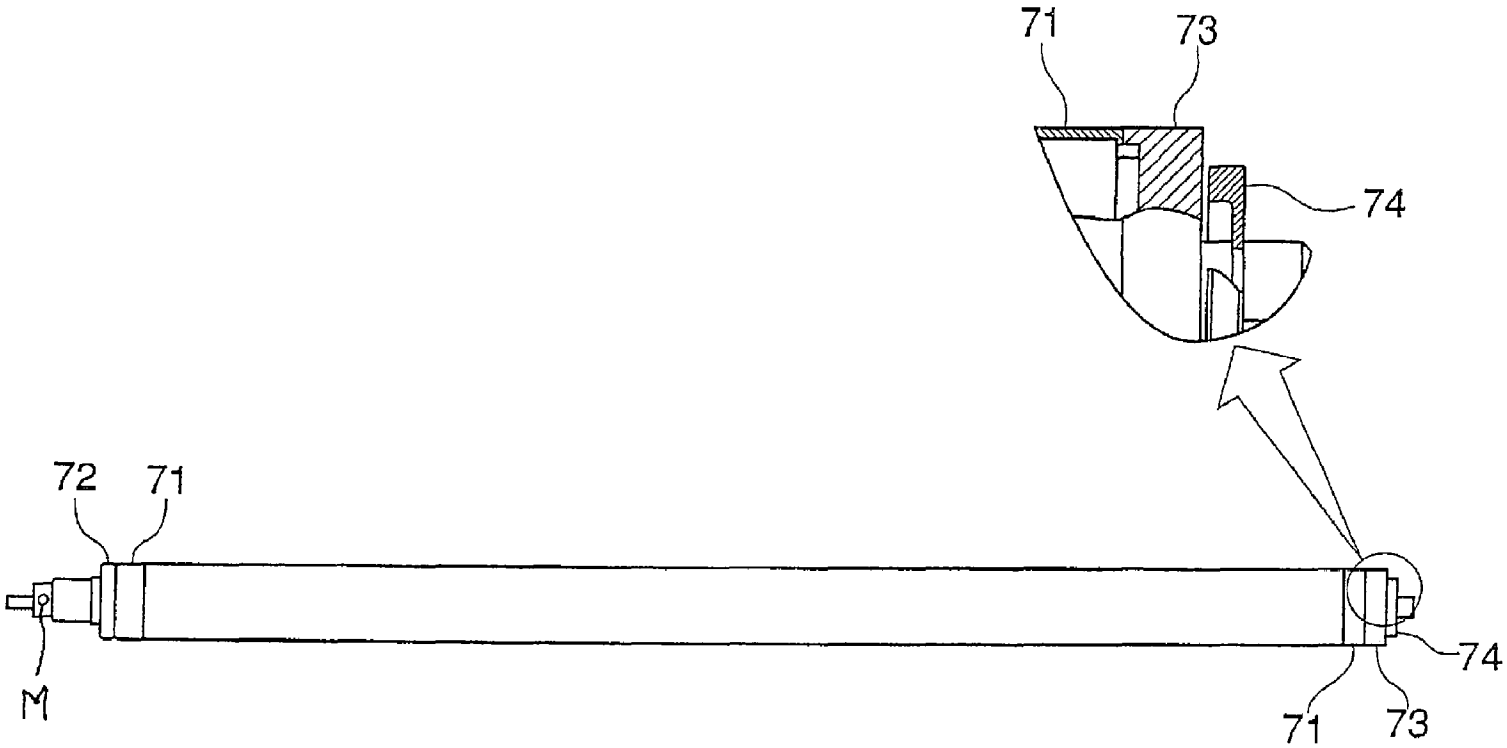
FIG. 12 is a structural diagram in which a plastic part is attached to an end of a developing roll.
Figure 13:
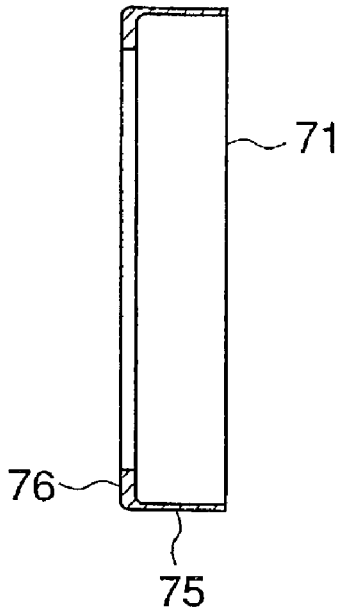
FIG. 13 is a structural diagram showing a plastic part to be attached to an end of a developing roll.
Figure 14:
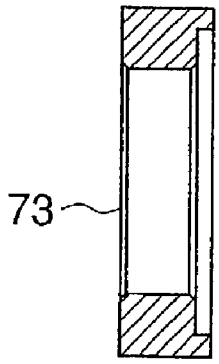
FIG. 14 is a structural diagram showing a plastic part to be attached to an end of a developing roll.
Figure 15:
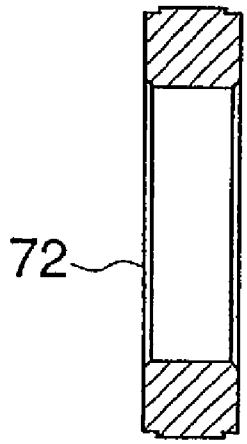
FIG. 15 is a structural diagram showing a plastic part to be attached to an end of a developing roll.
Figure 16:
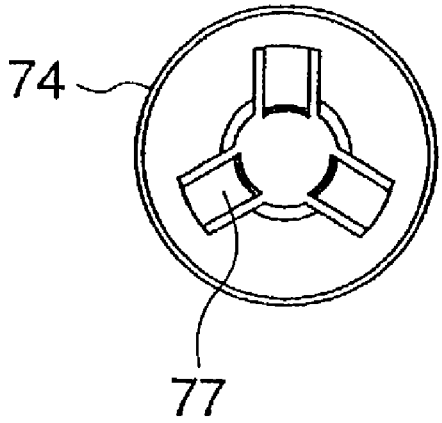
FIG. 16 is a structural diagram showing a plastic part to be attached to an end of a developing roll.

The developing roll 27 structured as above has a tracking roll 72 attached to its OUT side end with a roll seal 71 stuck to and covering the OUT side end as shown in FIG. 12. Another roll seal 71 sticks to and covers the IN side end of the developing roll 27, and a tracking roll 73 as well as a spacer roll 74 are attached to the IN side end. The roll seal 71 is formed of synthetic resin such as POM and is composed of a circumferential portion 75 and a ring-like portion 76 as shown in FIG. 13. The circumferential portion 75 sticks to and covers the circumference of the developing roll 27. The ring-like portion 76 is placed next to and outside the circumferential portion 75, has a circular opening, and sticks to and covers the circumferential faces of the flange members 49 and 50. Of the tracking rolls 72 and 73, the OUT side tracking roll 72 is formed into a ring from POM or other synthetic resin as shown in FIG. 14. The IN side tracking roll 73 too is formed into a ring from POM or other synthetic resin as shown in FIG. 15. The spacer roll 74 has at its center three claws 77, which protrude inward in the radial direction as shown in FIG. 16. The three claws 77 are fitted into a concave groove 78 that is provided in the vicinity of an end of the shaft 48 of the magnet roll 47.

The developing roll 27 which is the developer bearing body according to this embodiment is structured as above and, as shown in FIG. 4, is incorporated in the developing device 5. Thereafter the developing roll 27 is loaded as the process cartridge 2 into the printer main body 1 to be put into use as shown in FIG. 2. If foreign objects such as paper dust and coagulated coarse developer particles gather between the developing roll 27 and the layer thickness regulating member 36 of the developing device 5, the surface of the developing sleeve 46 of the developing roll 27 in the area clogged by the foreign objects is gradually worn away and its surface roughness is smoothed in the circumferential direction, which could cause a scar running along the circumference or the like. The scarring of the surface of the developing roll 27 is increased with time as the developing device 5 is used longer, and can cause degradation in image quality. For that reason, the developing device 5 comes to the end of its life as the developer initially stored in the developing device 5 is spent. The expired developing device 5 is replaced with new one by exchanging an old process cartridge 2 with a new process cartridge 2. The used process cartridge 2, or used printer, is recovered in accordance with a recycling process.

The used and recovered process cartridge 2 or printer is gathered in a recycle plant and receives a given recycling process including an inspection step which employs a method of inspecting a recycle developer bearing body according to this embodiment. Thus the developing roll 27 as a developer bearing body is prepared for reuse.

In this embodiment, the developer bearing body is recycled by a recycling method including: removing plastic parts from the used and recovered developer bearing body; cleaning the used developer bearing body from which the plastic parts have been removed; irradiating with light the surface of the developer bearing body which has been cleaned in the cleaning step to detect the intensity of light reflected by the developer bearing body using a light receiving unit, and automatically discerning the surface state of the developer bearing body regarding a scar or other defect based on an output signal from the light receiving unit; removing toner that adheres to portions of the developer bearing body which has undergone the discerning step, the portions being in the vicinity of ends in the axial direction of the developer bearing body; attaching new plastic parts to the developer bearing body from which the toner has been removed in the adhering toner removing step; and marking the developer bearing body to which the plastic parts have been attached to indicate that the developer bearing body is a recycled product.

Figure 17:
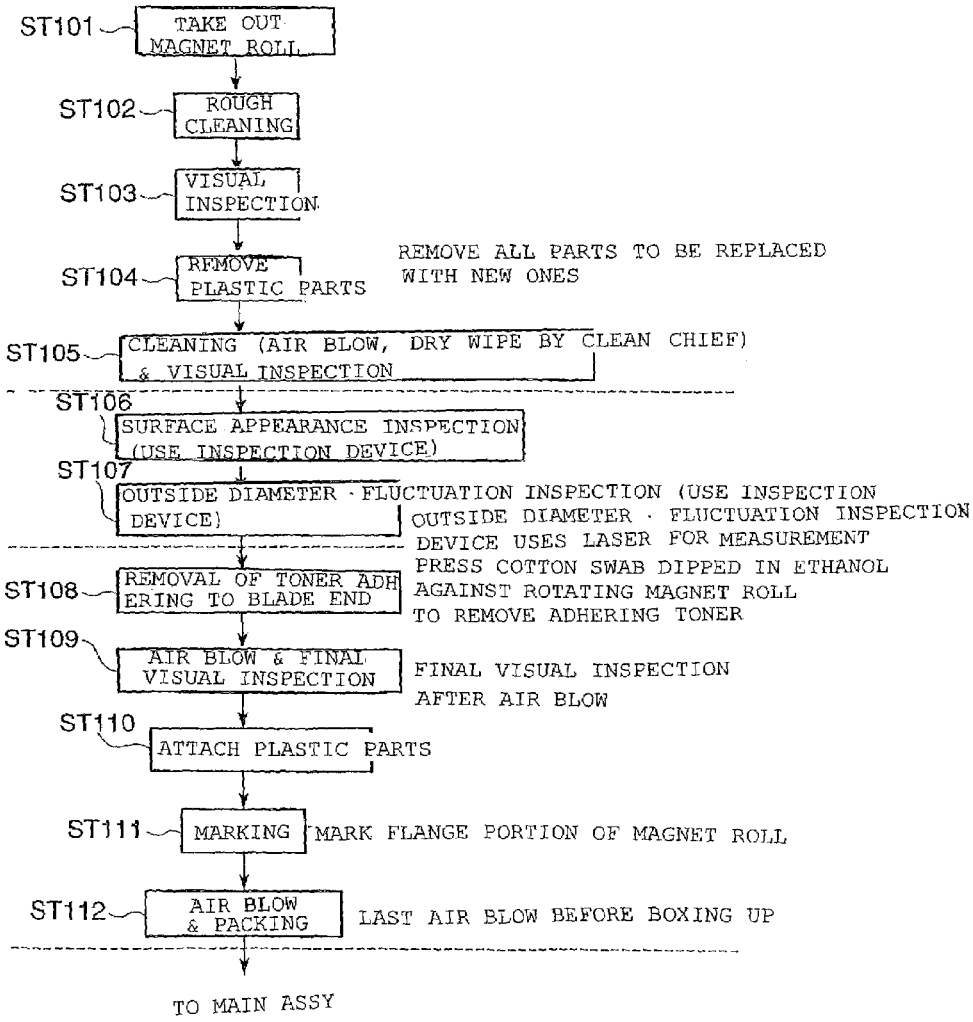
FIG. 17 is a flowchart showing a recycling method for a recycle developer bearing body according to Embodiment 1 of the present invention.

FIG. 17 shows a process of recycling the above developer bearing body.

The developing roll 27 structured as above to serve as the developer bearing body is first loaded in the developing device 5 as shown in FIG. 4. The used digital printer is recovered in a recovering step of a resource recycling production system. The recovered digital printer is sent to a recycle plant, where the digital printer is dismantled to take out individual parts including the photosensitive drum 3 and the developing device 5. Furthermore, the developing roll 27 as a developer bearing body is taken out of the developing device 5. In the above digital printer, the process cartridge 2 which houses the developing device 5 is exchangeable without exchanging the printer main body 1. Therefore, the process cartridge 2 in the used printer is recovered as one of image forming apparatus parts and then dismantled to take out of the developing device 5 individual parts such as the developing roll 27 as a developer bearing body. The step of dismantling the digital printer and the process cartridge 2 may be carried out in other places than the recycle plant.

In the dismantling step in the recycle plant, the developing roll 27 as a developer bearing body is picked by a method described below out of the developing device 5 and other image forming apparatus parts that are obtained through the dismantling. The developing roll 27 is recycled as one of recycled parts for an image forming apparatus. After the recycling process, the developing roll 27 is attached to a new developing device 5 and is used to assemble a process cartridge 2 which is new but includes recycled parts for an image forming apparatus.

Next, a step-by-step description is given with reference to FIG. 17 on a method of recycling the developing roll 27 as one of image forming apparatus parts. Note that FIG. 17 is provided for convenience in explaining a method of recycling the developing roll 27 as one of image forming apparatus parts, and that not all of the steps shown in FIG. 17 are indispensable.

1) Retrieval Step

The process cartridge 2 recovered as above is disassembled into components including the developing device 5. From the developing device 5, the developing roll 27 is taken out as shown in FIG. 17 (Retrieval Step: ST 101). In the step of retrieving the developing roll 27, the developing roll 27 is taken out while taking care not to bruise the surface of the developing sleeve 46.

2) Rough Cleaning Step

Figure 18:
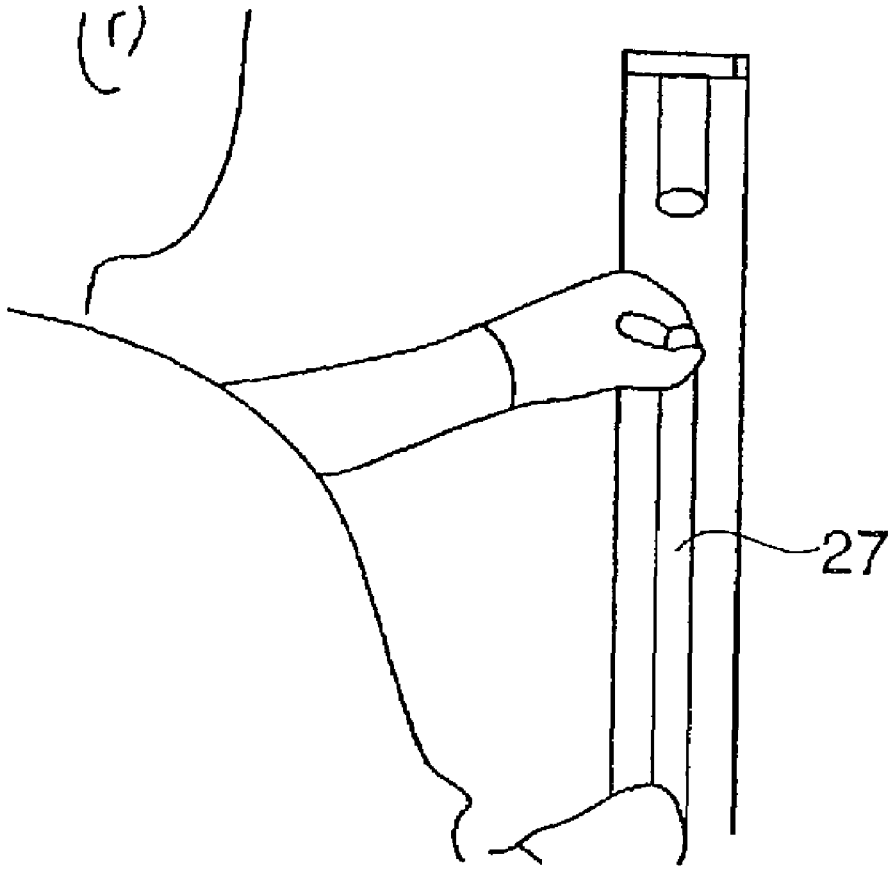
FIG. 18 is an explanatory diagram showing a recycling method for a recycle developer bearing body according to Embodiment 1 of the present invention.
Figure 19:
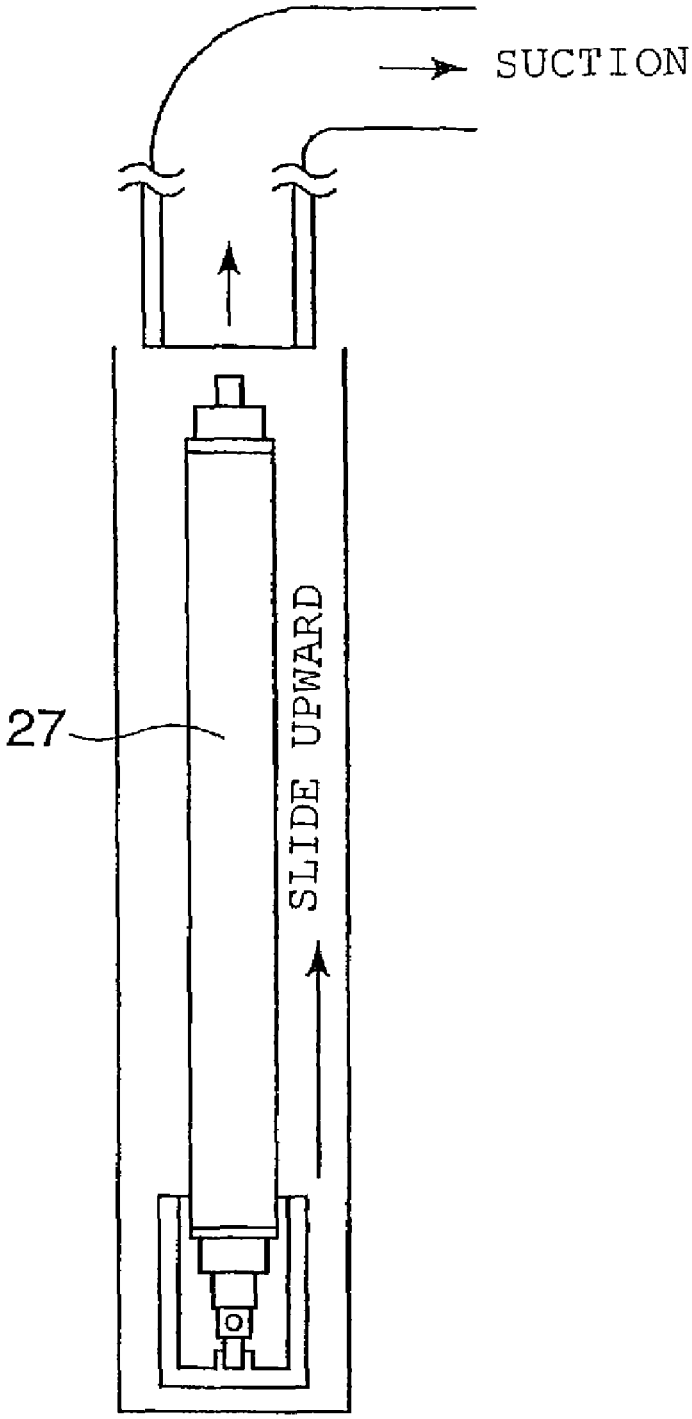
FIG. 19 is an explanatory diagram showing a recycling method for a recycle developer bearing body according to Embodiment 1 of the present invention.

In Rough Cleaning Step (ST 102) , the developing roll 27 taken out of the developing device 5 as described above is set in a rough cleaning jig 80 as shown in FIG. 18. To set the developing roll 27 in the jig, the shaft 48 of the developing roll 27 is held in both hands by its ends. As shown in FIG. 19, the developing roll 27 is slid upward by a not-shown slide mechanism of the rough cleaning jig 80 and is inserted into a cleaning nozzle 81. The cleaning nozzle 81 removes by suction developer adhering to the surface of the developer roll 27. If the developing roll 27 is bumped against something or dropped by accident in this step, the bumped or dropped developing roll is immediately thrown away as a reject (such rejects may be gathered and put in a dedicated bin until they are discarded)

3) Visual Inspection

Figure 20:
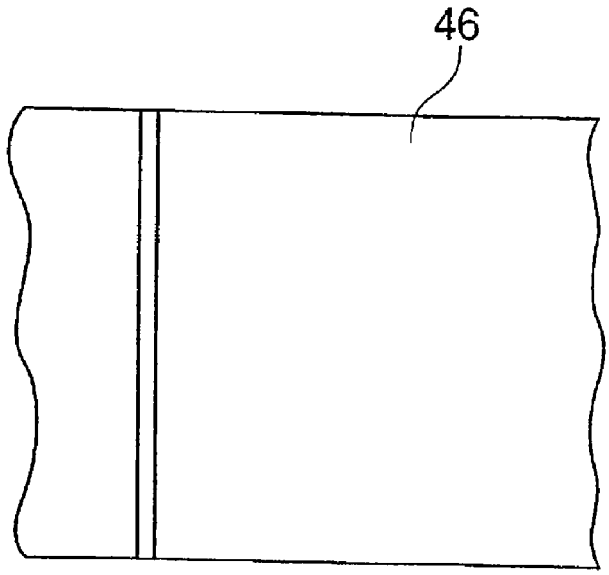
FIG. 20 is a schematic diagram showing a circumferential scar on the surface of a developing roll.

After the rough cleaning, the developing roll 27 is slid downward and pulled out of the cleaning nozzle 81. Then the shaft 48 of the developing roll 27 is held in both hands to put the developing roll 27 onto a reception tray which is not shown in the drawing. This is when visual inspection is done on the surface of the developing roll 27. If a significant scar or defect as the one shown in FIG. 20 is found on the developing roll 27 that is held in inspector's hands, the developing roll is cast away as a reject. In this step, the inspector has to take care not to touch the developing sleeve 46 of the developing roll 27. Depending on the type of the developer bearing body, the developer bearing body may be stored with toner remained adhered. In this case, the adhering toner is removed in the next step.

4) Primary Sorting Step and Plastic Parts Removing Step

Figure 21:
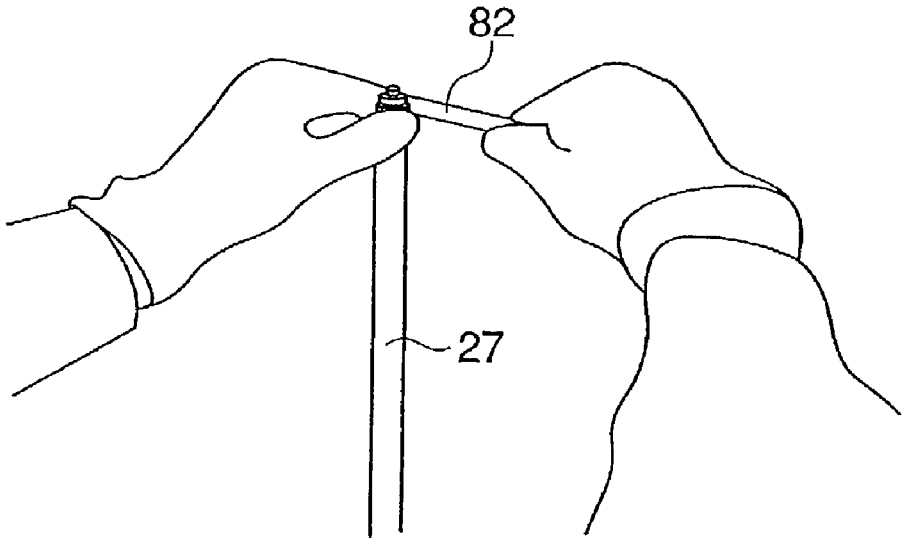
FIG. 21 is an explanatory diagram showing a recycling method for a recycle developer bearing body according to Embodiment 1 of the present invention.

Then the level of a circumferential scar on the surface of the developing roll 27 is observed by the naked eye. Comparing the scar on the developing roll 27 to a sample which shows the range of acceptable scars, whether the developing roll 27 is set onto a normal reuse process or rejected is decided (ST 103). Thereafter, as shown in FIG. 21, a spacer roll removing jig 82 is inserted between the spacer roll 74 and the tracking roll 73 which are attached to the IN side of the developing roll 27 to detach the spacer roll 74 utilizing the principle of leverage. The tracking roll 73 and the seal roll 71 which are attached to the IN side of the developing roll 27 are detached next. Similarly, the tracking roll 72 and the spacer roll 71 which are attached to the OUT side of the developing roll 27 are removed. If toner is fixed to an image quality region of the developing roll 27, such developing roll is sent to a blast recycle process.

5) Preliminary Inspection

Next, the developing roll 27 is held in both hands to check whether or not the rotary shaft 48 rotates normally. Also checked is the type of marking inscribed on the flange portion of the developing roll 27 as described later. If the developing roll 27 has no marking, it means that the developing roll has been new and used only once before collected and such developing roll is sent to a recycle process for a once-used developer bearing body or to blast treatment. If the developing roll 27 has a blue marking, it is sent to a recycle process for a twice-used developer bearing body. If the marking is green or red, the developing roll 27 is rejected and put on a tray for rejects. Sometimes the developing roll 27 of a different model could be mixed in and this should not be overlooked. A different model is discerned by the color of the developing sleeve, the shape of the tracking roll, and the like. When it is difficult to decide, a developing roll that is suspected of belonging to a wrong model is rejected.

6) Air Blow Cleaning Step

Figure 23:
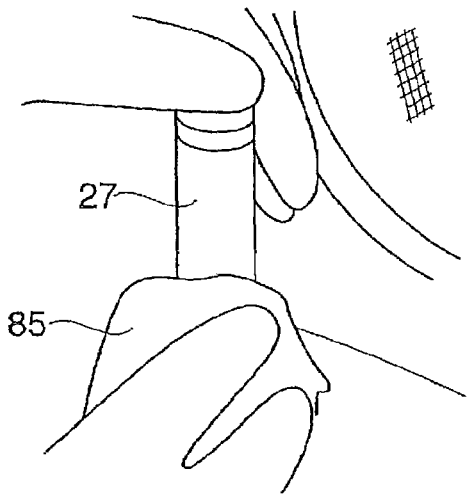
FIG. 23 is an explanatory diagram showing a recycling method for a recycle developer bearing body according to Embodiment 1 of the present invention.

In the air blow cleaning step (ST 105), as shown in FIGS. 22A and 22B, the entire developing roll 27 is subjected to air blow cleaning by an air gun 84 while the developing roll 27 stands upright with its IN side put into a developing roll erecting jig 83. The developing roll 27 should be cleaned particularly carefully at its ends where more toner adheres than any other portion of the developing roll 27. A portion where toner remains adhered after the air blow cleaning is dry-wiped by clean chief or the like as shown in FIG. 23, and then subjected to air blow cleaning once more.

7) Visual Inspection

Figure 24:
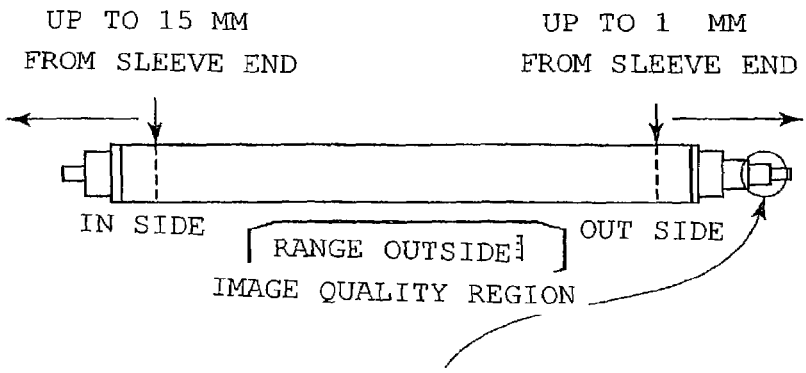
FIG. 24 is an explanatory diagram showing a developing roll.

At the same time, primary visual inspection is performed on the surface of the developing roll 27 (ST 105), and one having a stain that won't come out is rejected. It is also at this point that whether the developing roll 27 is to be sent to the recycle process for a once-used developer bearing body, or to the recycle process for a twice-used developer bearing body, or to the blast recycle process is checked as shown in FIG. 24. Different transportation trays are prepared for developing rolls directed to the recycle process for a once-used developer bearing body, developing rolls directed to the recycle process for a twice-used developer bearing body, and developing rolls directed to the blast recycle process for separate management. If toner is fixed to an image quality region of the developing roll 27, such developing roll is sent to the blast recycle process.

8) Surface Inspection Step

Next, a surface inspection device 88 is used to examine whether or not there is a scar or other defect on the surface of the developing roll 27 and, if there is, the size and the like of the scar or other defect on the surface of the developing roll 27 as shown in FIGS. 26A and 26B (ST 107). Every day before the plant starts operation, the surface inspection device 88 is adjusted for the threshold in accordance with the master sample following a given procedure and details of the adjustment are recorded. Adjustment according to the master sample is necessary also when trouble of the surface inspection device 88 is solved and after the power is turned off.

9) Measurement Procedure

A measurement procedure in the surface inspection device is described below.

The developing roll 27 is set in the surface inspection device 88 with its IN side end turned left, and a set button is depressed. Once the developing roll 27 is taken inside the surface developing device 88, the next developing roll 27 is set and the set button is depressed. The inspection device judges whether the developing roll 27 is acceptable or not to discharge an acceptable developing roll from one outlet and a rejected developing roll from the other outlet. An acceptable developing roll 27 is put on a tray for normal recycle. A rejected developing roll is put on a tray directed to a blast treatment process and sent to the blast recycle process. Then the operation described above is repeated.

10) Unloading

In the above surface inspection device 88, an operator depresses a UL button when the operation is interrupted or finished to take the developing roll 27 out of the inspection device. Note that the developing roll 27 has to be set in the surface inspection device 88 accurately. Also, the operator should be careful to avoid pinching his or her fingers in the surface inspection device 88.

11) Outside Diameter·Fluctuation Measuring Step

Figure 25:
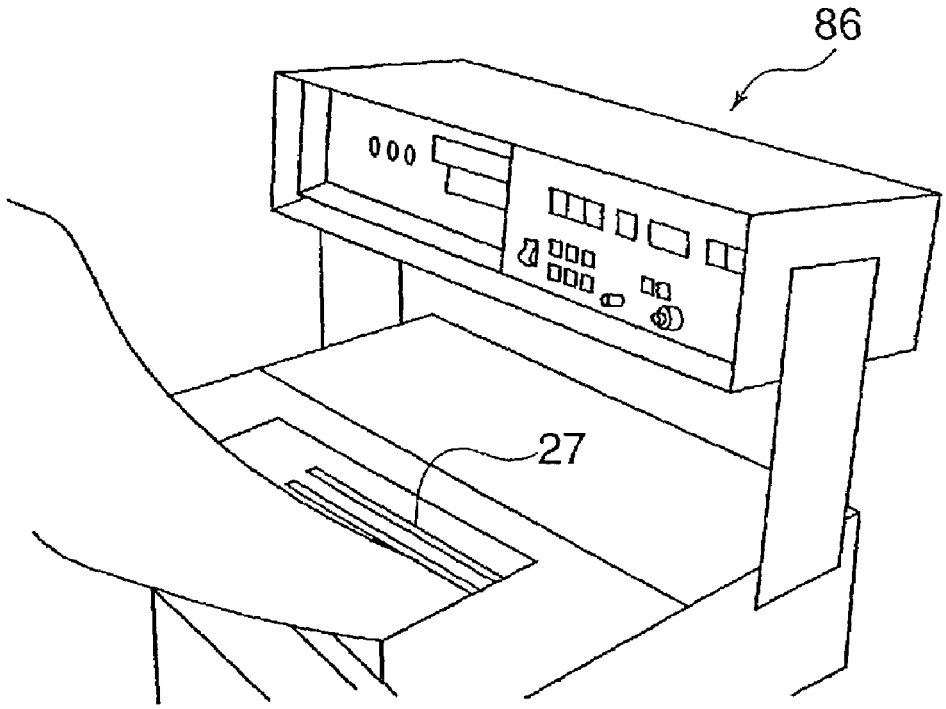
FIG. 25 is an explanatory diagram showing a recycling method for a recycle developer bearing body according to Embodiment 1 of the present invention.

Next, the outside diameter and fluctuation in outside diameter of the developing roll 27 to be reused are measured to judge whether they are within given ranges (ST 106). The outside diameter fluctuation measuring step employs a laser measuring device 86 which uses a laser beam as shown in FIG. 25. Every day before the plant starts operation, the laser measuring device 86 measures the master sample and checks whether or not fluctuation among measured values is within a given range (±5 μm standard). If the fluctuation is outside the given range, calibration is conducted so as to bring the fluctuation within the given range. Each time the operation period of the laser measuring device 86 reaches four to five hours, a roll portion which comes into contact with the developing roll 27 is cleaned and a laser portion is subjected to air blow cleaning.

12) Measurement Procedure

In the outside diameter·fluctuation measuring step, the measurement is started as a start button is depressed while the developing roll 27 is placed on the laser measuring device 86 as shown in FIG. 25. The measurement result, NO or GO, is displayed in a control box. If the developing roll 27 is acceptable, it is put on a tray for acceptables. On the other hand, if the developing roll 27 is rejected, it is put on a tray for rejects.

13) Caution

Thereafter, the above outside diameter fluctuation measuring step is repeated. Note that the developing roll 27 has to be set in the laser measuring device 86 accurately. Also, the operator should be careful to avoid pinching his or her fingers in the laser measuring device 86.

14) End-adhering Toner Removing Step

Figure 27:
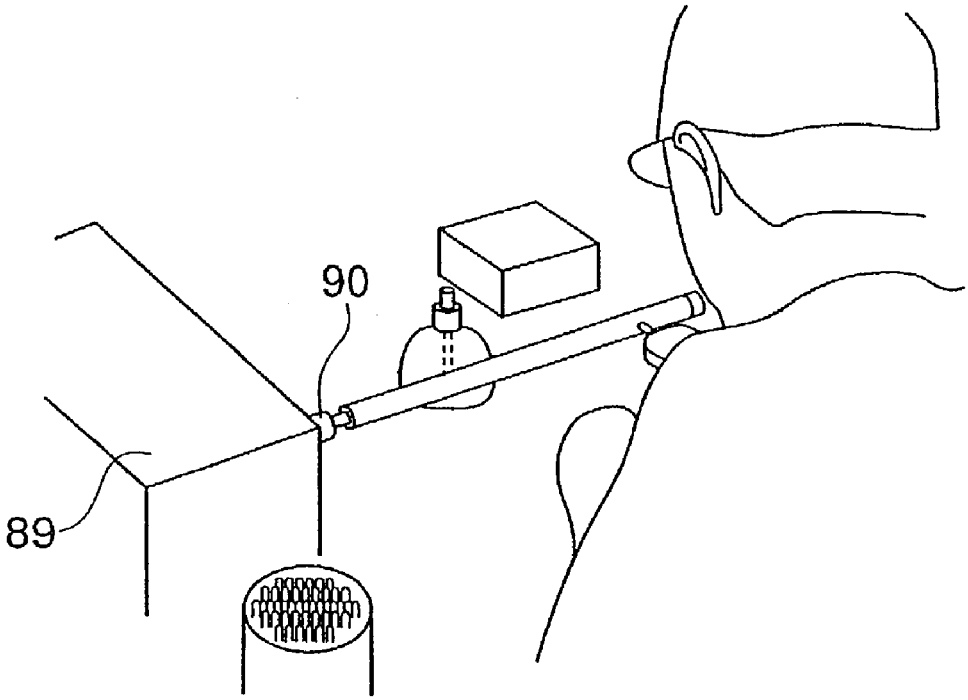
FIG. 27 is an explanatory diagram showing a recycling method for a recycle developer bearing body according to Embodiment 1 of the present invention.
Figure 28:
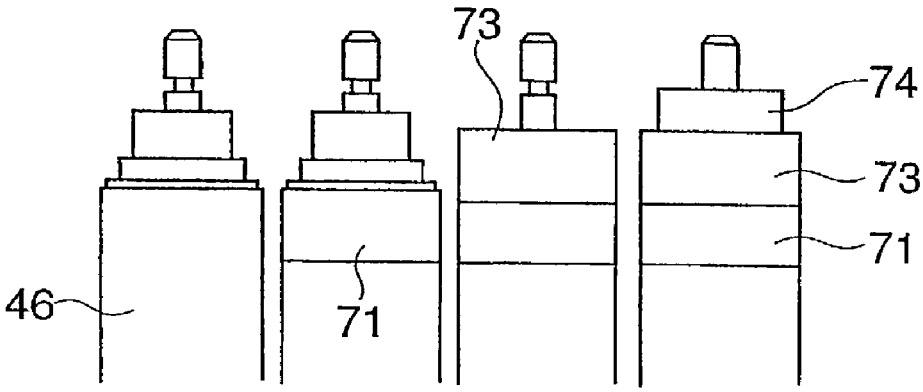
FIG. 28 is an explanatory diagram showing a recycling method for a recycle developer bearing body according to Embodiment 1 of the present invention.

Then the developing roll 27 is taken out of a not-shown reception tray by holding the shaft 48 of the developing roll 27 in both hands with its OUT side end turned left. An end of the shaft 48 on the OUT side of the developing roll 27 is inserted into a chuck portion 90 of a rotator 89 and is turned clockwise to be fastened as shown in FIG. 27. Then a start switch of the rotator 89 is thrown to rotate the developing roll 27 with its IN side chucked. A cotton swab 91 is dipped into a solvent such as ethanol and is pressed against toner adhering to the developing roll 27 to remove toner stain. If ethanol runs all over the surface of the developing roll 27, the excess ethanol is wiped with clean chief or the like. Desirably, the cotton swab is always slid over the surface outward to prevent ethanol from reaching an image quality region of the developing roll 27. After the adhering toner is removed, the developing roll is detached from the rotator and put on a tray.

15) Parts Assembling

Next, the shaft 48 of the developing roll 27 is held in left and right hands to check the marking that shows how many times the developing roll is recycled as well as whether or not the shaft 48 rotates normally. Then the entire developing roll 27 is subjected to air blow to remove dust or the like clinging thereto. Furthermore, the surface of the developing roll 27 is observed by the naked eye to examine a superficial scar, a stain, or grease consulting the sample which shows the range of acceptable scars (ST 109).

16) Attaching Plastic Parts

Figure 29:
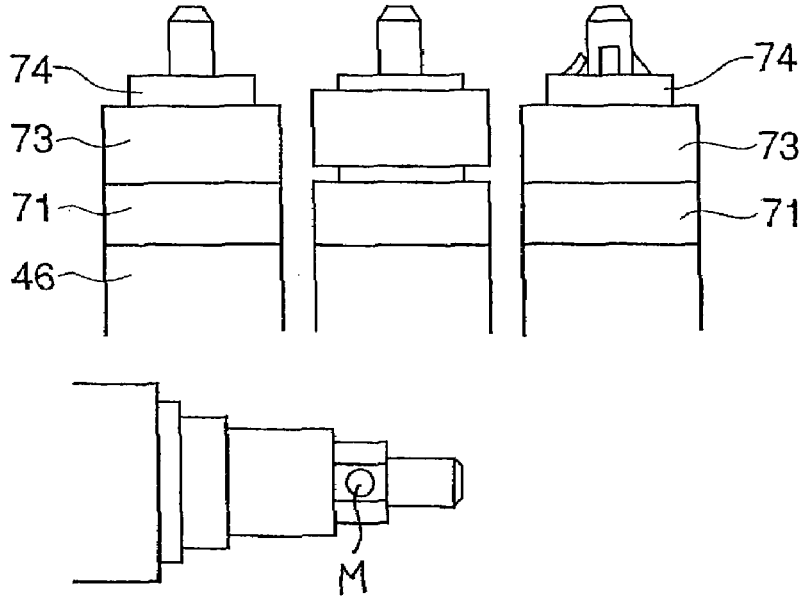
FIG. 29 is an explanatory diagram showing a recycling method for a recycle developer bearing body according to Embodiment 1 of the present invention.

If the developing roll 27 passes the visual inspection, the roll seal 21, the tracking roll 73, and the spacer roll 74 are inserted in the order stated to the IN side of the developing roll 27 as shown in FIG. 29. The IN side is then pushed into a not-shown attaching jig until it clicks to attach the seal and the rolls to the developing roll 27 (ST 110). If the developing roll 27 is rejected by the visual inspection, it is put into a bin where rejects are gathered. When attaching the tracking roll 73 and the spacer roll 74, make sure that they face the right direction. The roll seal 71 and the tracking roll 72 are attached to the OUT side of the developing roll 27. If the plastic parts are bruised, image quality is adversely affected and therefore they should be replaced with new ones. Since the plastic parts constituting the developing roll 27 are structured differently from plastic parts for a different model, pay attention not to attach wrong parts.

17) Marking Step

Figure 30:
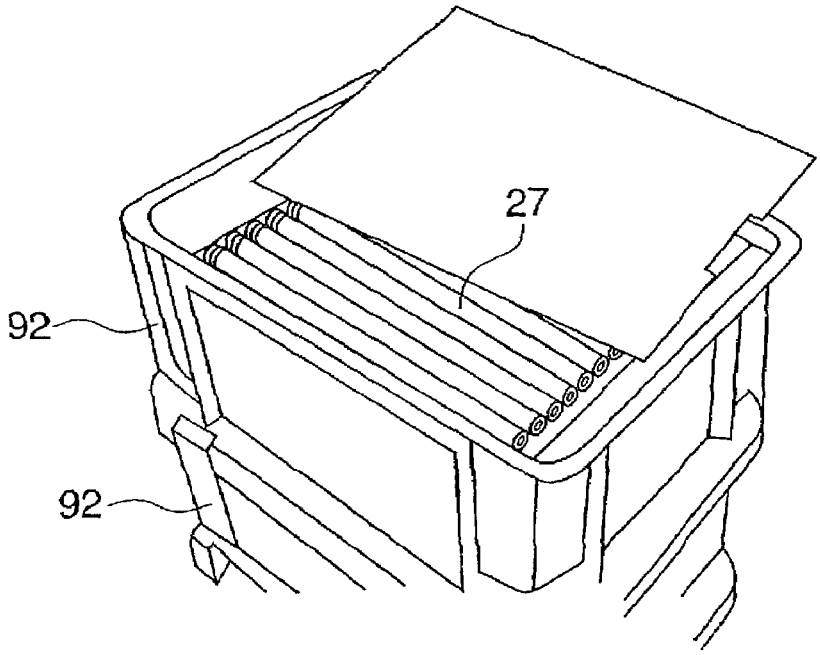
FIG. 30 is an explanatory diagram showing a recycling method for a recycle developer bearing body according to Embodiment 1 of the present invention.

After the developing roll 27 finishes the parts assembling step to be put into use again and ten of such developing rolls are obtained, a visual inspection is performed on the plastic parts to check for missing parts, mix-up with wrong types, ill-fitting, or the like. Boxes and trays for transportation are thoroughly cleaned by air blow before they are used. Then if the developing roll 27 is to be recycled for the first time, its flange portion is marked with a blue permanent marker. If the developing roll 27 is to be recycled for the second time, its flange portion is marked with a red permanent marker at a position that does not overlap the blue recycle marking the flange portion already has. Making sure that there are ten developing rolls in the reception tray, the developing rolls are subjected to air blow as shown in FIG. 30. The reception tray is then put into a transportation box 92 and the box is lidded.

18) Packing

When four reception trays (40 developing rolls) are gathered in one transportation box 92, the lid is closed and an identification tag is attached to the transportation box 92. The transportation boxes 92 are loaded onto a pallet with each box facing the same direction. Basically, six transportation boxes constitute one level and four levels of them are loaded onto one pallet. If remaining transportation boxes are not enough to make one level, they too are loaded to the pallet. The transportation boxes on the uppermost level are wrapped upon shipment.

The developing roll 27 as a developer bearing body is reused after the recycling process in a recycle plant as described above. In the above-described Surface Inspection Step, 7) , whether or not the surface of the developing roll 27 has a scar or other defect is inspected.

The inventors of the present invention have made an extensive research on to what degree the surface of the developing roll is allowed to scar before the scarred developing roll affects the image quality upon reuse.

Therefore, the inventors of the present invention have found that the surface roughness Ra (JIS B 0601) of the developer bearing surface having scars or other defects may be configured to be 0.8 μm or more, even when scars or other defects are developed on the developer bearing surface of the developer bearing body from previous use.

Also, in this embodiment, the surface roughness Ra of the developer bearing surface of the developer bearing body is set to 0.9 to 2.3 μm when the developer bearing body is new.

Further, in this embodiment, in the recycle developer bearing body obtained by recovering a used developer bearing body and performing a given inspection for reuse, it is configured that, even when scars or other defects are developed on the developer bearing surface of the developer bearing body from previous use, the surface roughness Ra of each of the scars is 0.8 μm or more, and that the width in the axial direction of each of the scars or other defects is 0.3 mm or less.

Further, in this embodiment, in the recycle developer bearing body obtained by recovering a used developer bearing body and performing a given inspection for reuse, it is configured that, even when scars or other defects are developed on the developer bearing surface of the developer bearing body from previous use, the surface roughness Ra of each of the scars is 0.8 μm or more, and that the distance between the center in the axial direction of one of the scars or other defects and the center in the axial direction of its adjacent scar or defect is 5 mm or more.

Experiment 1

The inventors of the present invention have conducted an experiment in which a halftone image is printed onto 4000 sheets of A4 size recording paper a day in three separate printing operations by a digital printer structured as shown in FIGS. 3 and 4. This process is repeated until images are formed onto 72000 sheets in total of recording paper which are separated into a group of 0 to 36000 sheets and a group of 36001 to 72000 sheets. The experiment is to examine the width of a scar appeared on the surface of the developing roll 27, the surface roughness Ra of the scar, and image streak incidence degree (incidence rate of streaks in an image).

The surface roughness of a scar appeared on the surface of the developing roll 27 is measured by SURCOM 1400D-3DF, a product of Tokyo Seimitsu Co., Ltd. The width of a scar appeared on the surface of the developing roll 27 is measured by Video Microscope VH-6300, a product of Keyence Corporation. The image streak incidence grade is estimated by test subjects through a sensory test in which the degree of blank spot in a combination of black paper and halftone is graded from Grade 0 to 5 by visual comparison to a sample which shows an acceptable range.

Figure 31:
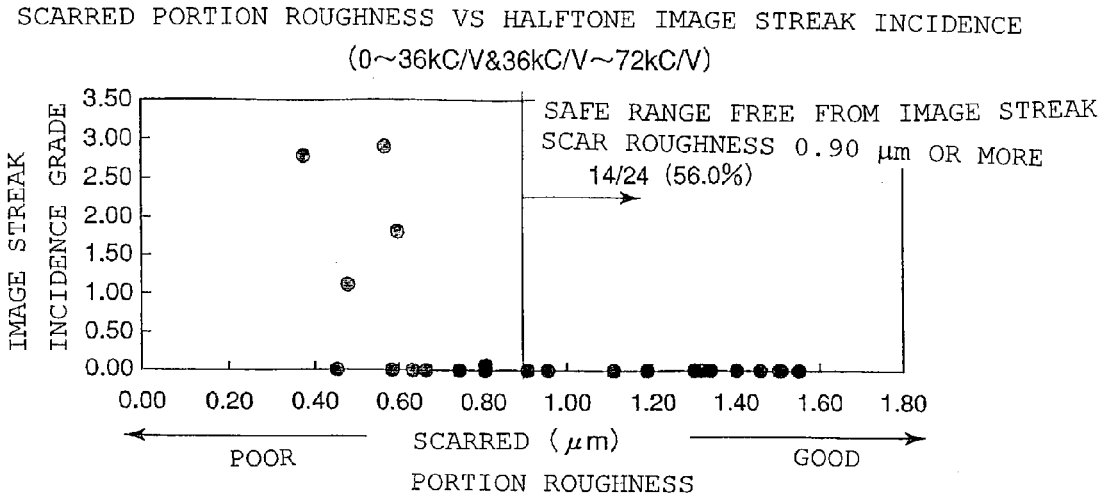
FIG. 31 is a graph showing inspection results obtained by an inspection method for a recycle developer bearing body according to Embodiment 1 of the present invention.

FIG. 31 shows results of the experiment regarding the surface roughness Ra of a scarred area on the surface of the developing roll 27 and the image streak incidence grade.

As is clear from FIG. 31, the image streak incidence grade is 0.00 and reuse of the developing roll 27 having a scar on its surface does not degrade image quality if the surface roughness Ra of the scarred area is 0.80 μm or higher to be on the safe side, more preferably, 0.90 μm or higher to be on the safe side.

Figure 32:
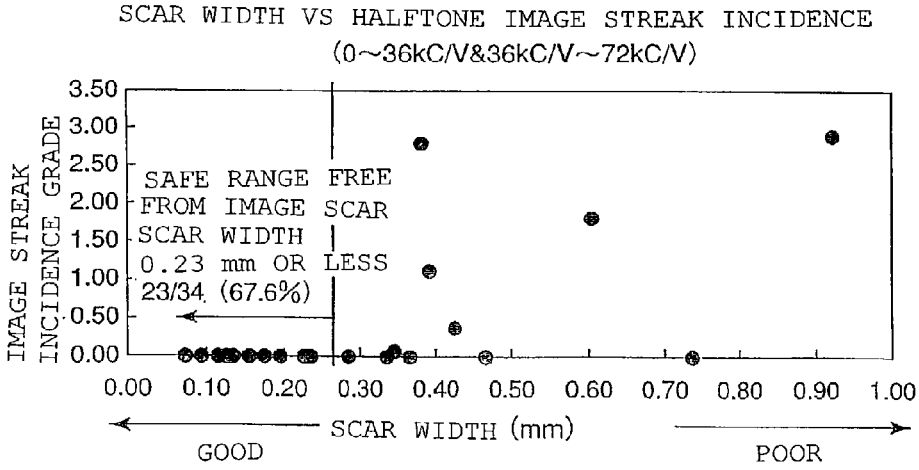
FIG. 32 is a graph showing inspection results obtained by the inspection method for a recycle developer bearing body according to Embodiment 1 of the present invention.

Also, FIG. 32 shows results of the experiment regarding the width of a scarred area on the surface of the developing roll 27 and the image streak incidence grade.

As is clear from FIG. 32, the image streak incidence grade is 0.00 and reuse of the developing roll 27 having a scar on its surface does not degrade image quality if the width of the scarred area is 0.23 μm or shorter to be on the safe side, more preferably, 0.30 μm or shorter.

Figure 33:
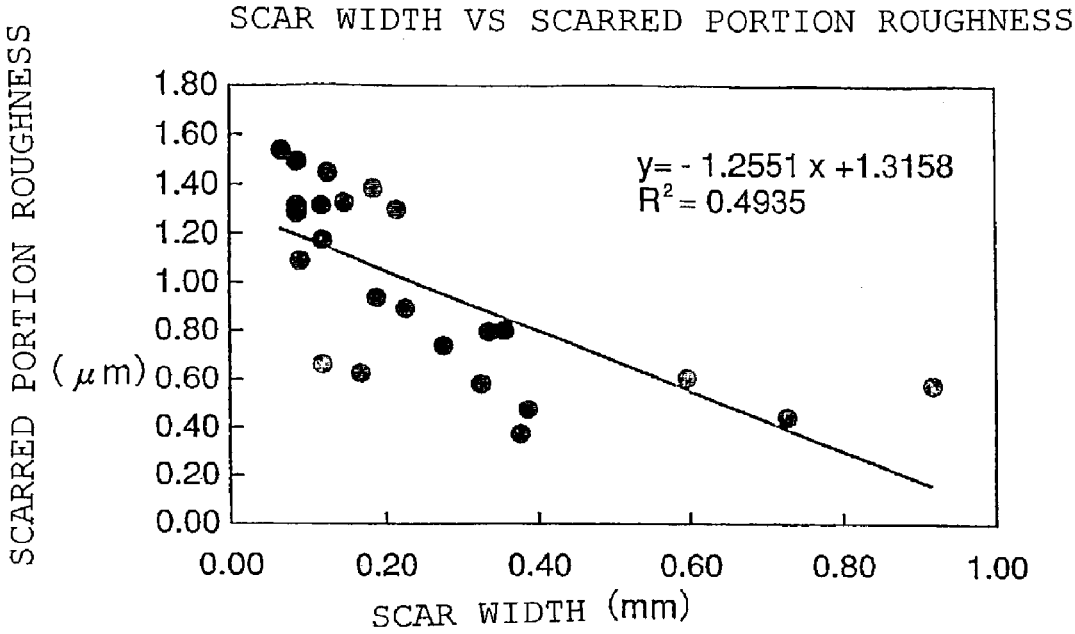
FIG. 33 is a graph showing inspection results obtained by the inspection method for a recycle developer bearing body according to Embodiment 1 of the present invention.

FIG. 33 shows the relation between the width of a scar on the surface of the developing roll 27 and the surface roughness of the scarred area. From FIG. 33, it is clear that there is a substantially negative correlation between the width of a scar on the surface of the developing roll 27 and the surface roughness of the scarred area.

FIG. 34 shows at once the relation among the width of a scar on the surface of the developing roll 27 and the surface roughness Ra of the scarred area, and image quality defect.

It is again proved by FIG. 34 that there is no fear of image quality defect if a scarred area on the surface of the developing roll 27 is 0.90 μm or higher and the width of the scar is 0.23 μm or less to be on the safe side.

Experiment 2

The inventors of the present invention have conducted next an experiment to find out how far plural scars existing on the surface of the developing roll 27 should be apart from one another to avoid an image quality problem.

It has been confirmed that, when circumferential scars serious enough to grade poorly on the above image streak incidence grade system are at a close distance from each other, they act as one scar to cause a wide, long, white streak in an image.

As a result of the experiment performed by the inventors of the present invention, it has been found that no image quality problem arises when a first circumferential scar having a width of 0.22 mm and a surface roughness of 1.31 μm and a second circumferential scar having a width of 0.32 mm and a surface roughness of 0.65 μm are 2 mm apart from each other.

The second circumferential scar having a width of 0.32 mm and a surface roughness of 0.65 μm slightly exceeds the acceptable range of the above image streak incidence grade system. However, a scar of this degree 2 mm apart from the first scar which is acceptable according to the image streak incidence grade system does not cause an image quality problem.

The data shows that, when there are plural scars that pose no problem in terms of the above image streak incidence grade, an acceptable image streak incidence grade is obtained if those scars are not located in an area in the axial direction 2.5 mm to left and right each, 5.0 mm in total, to be on the safe side.

Experiment 3

Another experiment that has been conducted by the inventors of the present invention is to see how the width and surface roughness of a scar on the surface of the used developing roll 27, which has been used once and already scarred on the surface prior to recovery, are changed after the developing roll 27 is used to print images onto 72000 sheets of recording paper, which corresponds to twice the normal life span of the process cartridge 2.

Figure 35:
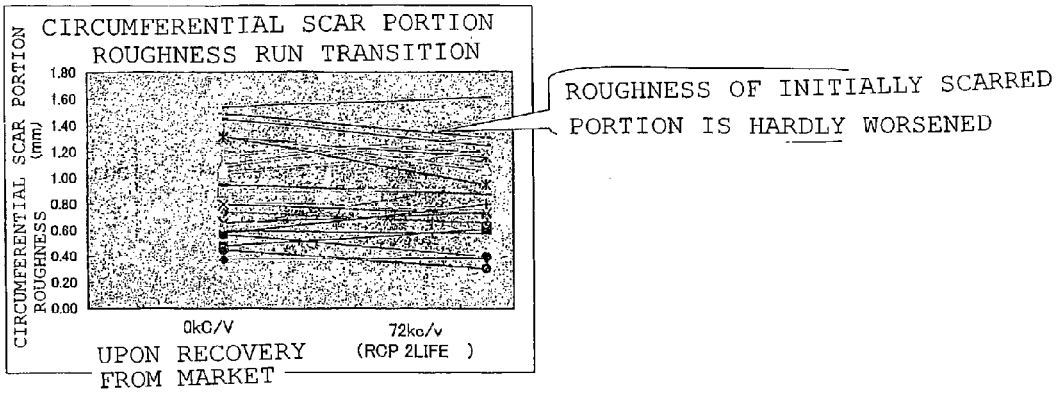
FIG. 35 is a graph showing inspection results obtained by the inspection method for a recycle developer bearing body according to Embodiment 1 of the present invention.
Figure 36:
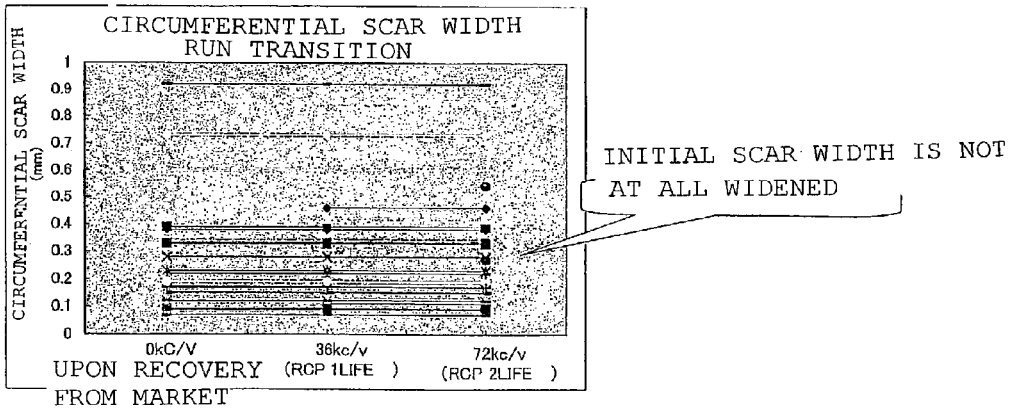
FIG. 36 is a graph showing inspection results obtained by the inspection method for a recycle developer bearing body according to Embodiment 1 of the present invention.

FIGS. 35 and 36 show results of the above experiment.

As is apparent from FIGS. 35 and 36, when the developing roll 27 which has been used once and is scarred on the surface is reused, the width of the scar is not changed at all although there is a slight change in surface roughness of the scar.

Accordingly, no image quality problem arises from reuse of the developing roll 27 which has been used once and is scarred on the surface if the scar is within a given width range and a given surface roughness range.

FIGS. 37A to 37C and FIGS. 38A to 38C show results of an experiment conducted to see how the surface roughness is changed in a new developing roll 27 and in a not-scarred portion of a developing roll 27 that is recovered from the market.

As is apparent from FIGS. 37A to 37C and FIGS. 38A to 38C, the surface roughness of the developing roll 27 that is recovered from the market is within the range designated by the spec., although its fluctuation is increased compared to the new developing roll 27. Therefore it is again proved that no image quality problem arises from reuse of the scarred developing roll 27 if the scar is within a given width range and a given surface roughness range, as described above.

Experiment 4

The inventors of the present invention have conducted next an experiment to see how much the developing roll 27 is changed in outside diameter and how much it fluctuates in outside diameter after the developing roll 27 is used to print onto 72000 sheets. The outside diameter and fluctuation in outside diameter of the developing roll 27 is measured by Laser Scan Micrometer LSM-3000, a laser measuring device manufactured by Mitutoyo Corporation.

FIGS. 39A to 39C show results of the above experiment.

As FIG. 39 clearly shows, the outside diameter and fluctuation in outside diameter of the developing device 27 stay within the ranges designated by the spec. even after printing 72000 sheets.

Therefore, the surface inspection device 200 according to this embodiment is structured so as to discern whether or not the surface roughness Ra of the developing roll 27 is 0.8 μm or higher throughout including a portion having a scar or other defect; if the surface roughness Ra of the scar or other defect is 0.8 μm or higher, whether or not the width in the axial direction of the defect is 0.3 mm or less; and, if the surface roughness Ra of the defect is less than 0.8 μm, whether or not the distance between the center in the axial direction of one defect such as a scar and the center in the axial direction of its adjacent defect is 5 mm or more. This is achieved by appropriately setting the REF values of comparators 224 and 226 shown in FIGS. 30 and 32 and by appropriately setting the threshold in the scan area shown in FIG. 31. Whether or not the surface roughness Ra of the developing roll 27 is 0.8 μm or higher throughout including a portion having a scar or other defect; and if the surface roughness Ra of the scar or other defect is 0.8 μm or higher, whether or not the width in the axial direction of the defect is 0.3 mm or less are determined by making a master sample of a circumferential scar which has, for example, a surface roughness Ra of 0.9 μm and a width of 0.23 μm, making a correction each time the inspection device is started, and adjusting the threshold (comparator level) by turning a voltage dial. However, for the developing roll recovered from the market, the surface roughness in a portion where no scar or other defect is present is always equal to or more than 0.8 μm. The inspection device cannot judge whether or not the distance between the center in the axial direction of one defect such as a scar and the center in the axial direction of its adjacent defect is 5 mm or more while the surface roughness Ra of the defect is less than 0.8 μm. Therefore, even when adjacent scars pass the examination by the inspection device, they are measured with a tape measure and judged in the final visual inspection.

The above description proves that no image quality problem arises from reuse of the developing roll 27 that has a scar on its surface from previous use in printing at least 72000 sheets, which corresponds to twice the life span of the process cartridge 2, as long as the width and surface roughness of the scar are within given ranges.

However, it is very difficult for the naked eye to discern whether or not the width and surface roughness of a scar on the surface of the used developing roll 27 are within given ranges in the surface inspection step of the above-described process of recycling the developing roll 27.

For that reason, even though it is known that the used developing roll 27 can be reused as long as the width and surface roughness of a scar on the surface of the used developing roll 27 are within given ranges, putting this knowledge immediately into practice in the recycling process at a recycle plant is not easy.

The inventors of the present invention therefore have investigated about a surface inspection device which can automatically examine whether or not the width and surface roughness of a scar on the surface of the used developing roll 27 are within given ranges.

As a result of the investigation, the inventors of the present invention have come to employ a surface inspection device structured as follows:

The recycle developer bearing body inspection device for inspecting the surface state of a used and recovered developer bearing body for a scar of other defect with the intention of recycling according to this embodiment is configured to include: a light radiating unit that irradiates the surface of the developer bearing body with light; a light receiving unit that receives light reflected by the developer bearing body; and a discerning unit that discerns the surface state of the developer bearing body regarding a scar or other defect based on an output signal from the light receiving unit.

Also, the recycle developer bearing body inspection device according to this embodiment is configured such that a contact image sensor placed at a very close distance from the surface of the developer bearing body is used as the light receiving unit that receives light reflected by the developer bearing body.

Also, the recycle developer bearing body inspection device according to this embodiment is configured to further include: a detecting unit that detects light reflected at the surface of the developer bearing body; and a controlling unit that keeps constant the intensity of light reflected at the developer bearing body surface where no scar or other defect is present by controlling the intensity of light emitted from the light radiating unit.

Also, the recycle developer bearing body inspection device according to this embodiment is configured such that the device includes a driving unit that rotates the developer bearing body in the circumferential direction with the developer bearing body facing the light receiving unit, and that the discerning means integrates, along the circumferential direction, reflected light from the same point in the axial direction on the surface of the developer bearing body to discern the surface state of the developer bearing body regarding a scar or other defect from the obtained integration value.

Figure 40:
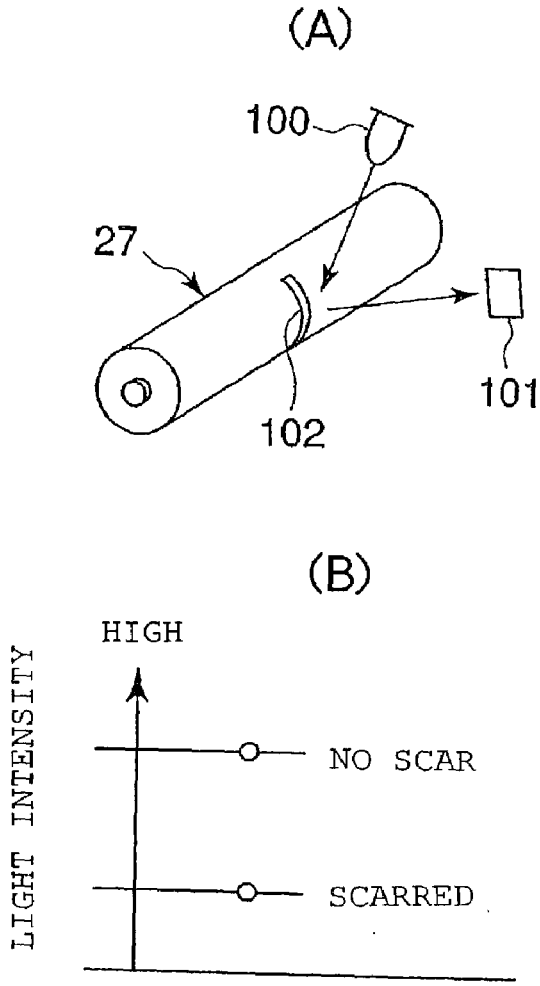
FIGS. 40A and 40B are explanatory diagrams showing the principle of an inspection method and inspection device for a recycle developer bearing body according to Embodiment 1 of the present invention.

According to the principle of the inspection device for a recycle developer bearing body, as shown in FIGS. 40A and 40B, the surface of the developing sleeve 48 is irradiated with light from a light irradiating unit (light source) 100 such as LED, light reflected at the surface of the developing sleeve 48 is received by a light receiving unit 101 such as a photosensor, and the surface state of the developing roll 27 regarding a scar or other defect is discerned by utilizing the fact that the intensity of light reflected at the surface of the developing sleeve 48 varies depending on the presence or absence of defects 102 such as a scar and a stain on the surface of the developing sleeve 48.

Figure 41:
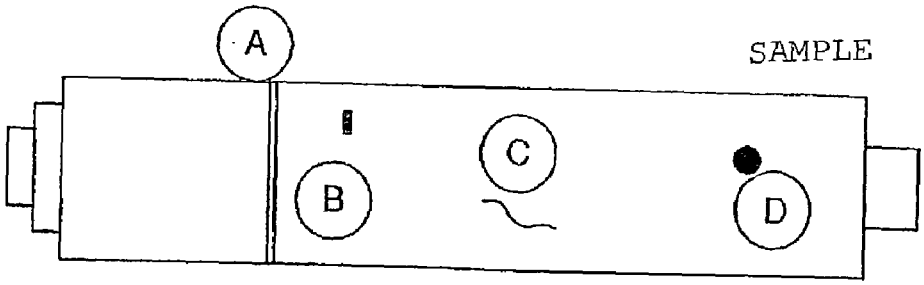
FIG. 41 is an explanatory diagram showing defects such as scars on the surface of a developing roll.

Examples of the defects 102 such as a scar and a stain on the surface of the developing sleeve 48 of the developing roll 27 are shown in FIG. 41: one continuous scar 102*a* which runs in the circumferential direction, a partial, small scar or stain (by adhered toner or the like) 102*b*, an axially stretching scar 102*c*, and a large, partial scar or stain (by adhered toner or the like) 102*d*. Of the defects 102 including scars and stains, a stain by adhering toner is removed in the cleaning or similar step of the above-described recycling process and, if the cleaning or similar step is unsuccessful, the developing roll 27 is sent to the blast treatment process. The continuous scar 102*a* which runs in the circumferential direction, the partial, small scar 102*b*, and the axially stretching scar 102*c* can be recognized by the inspection in the surface inspection step. The large, partial scar 102*d* can be recognized by visual inspection.

In the inspection by the inspection device, if the developing sleeve 48 of the developing roll 27 has a lustered surface, a scar of other defect on the surface of the developing sleeve 48 absorbs or scatters light to make the intensity of light that is reflected at the scar lower than that of a not-scarred area as shown in FIG. 40B. Therefore, whether or not the developing sleeve 48 has a scar, stain, or other defect on its surface, or whether or not the scar, stain, or other defect exceeds a given point can be discerned by comparing an output signal from the light receiving unit 101 to a certain threshold.

Based on this, the above inspection device for a recycle developer bearing body is structured so as to measure the intensity of light reflected from the surface of the cylindrical developing sleeve 48 by a line camera 104 while rotating the developing sleeve 48 as shown in FIG. 42A. Then the entire surface of the developing sleeve 48 can be included in the defect detection range of the device.

Figure 42:
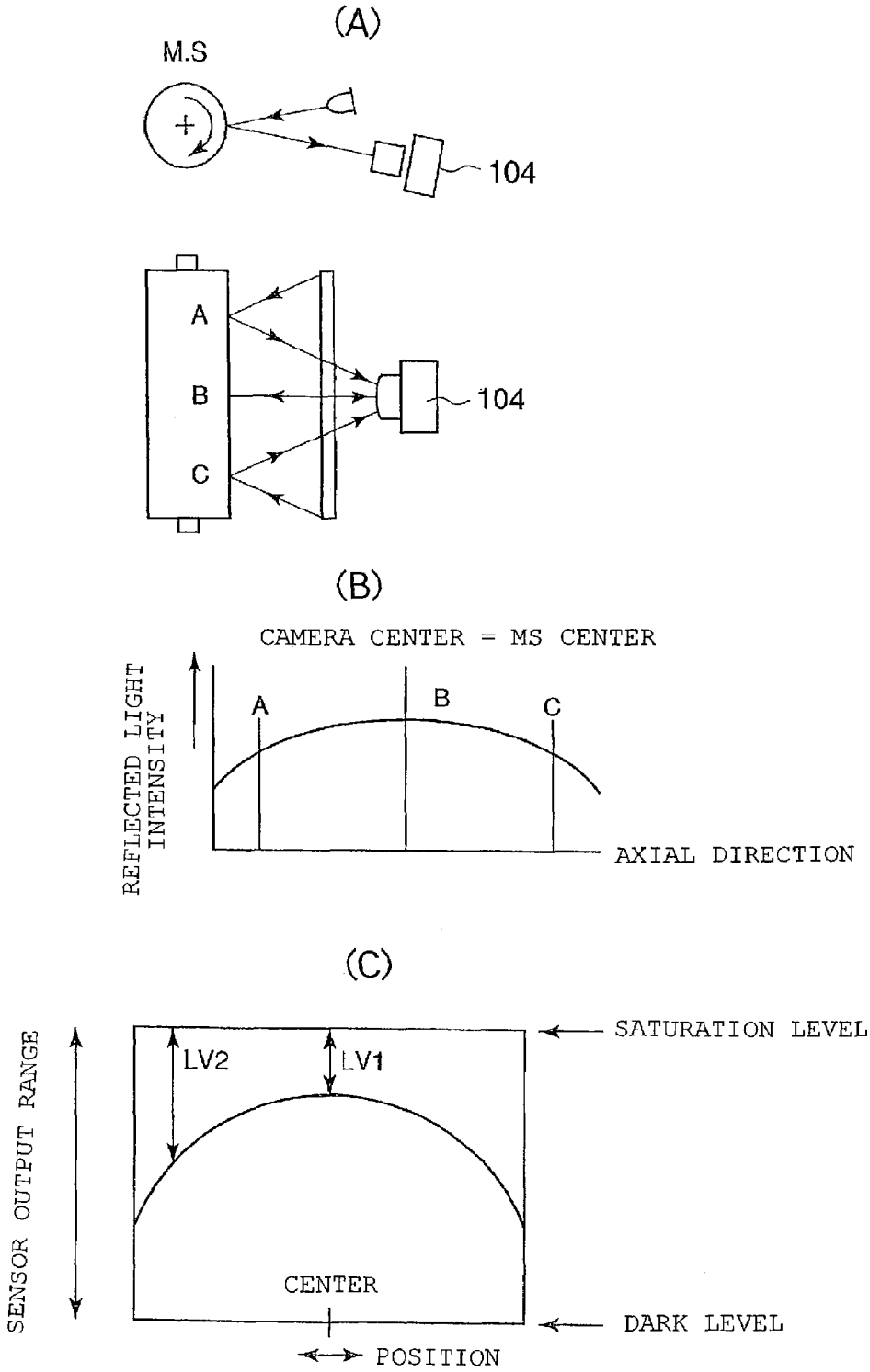
FIGS. 42A to 42C are explanatory diagrams showing an inspection device for a recycle developer bearing body according to Embodiment 1 of the present invention.
Figure 44:
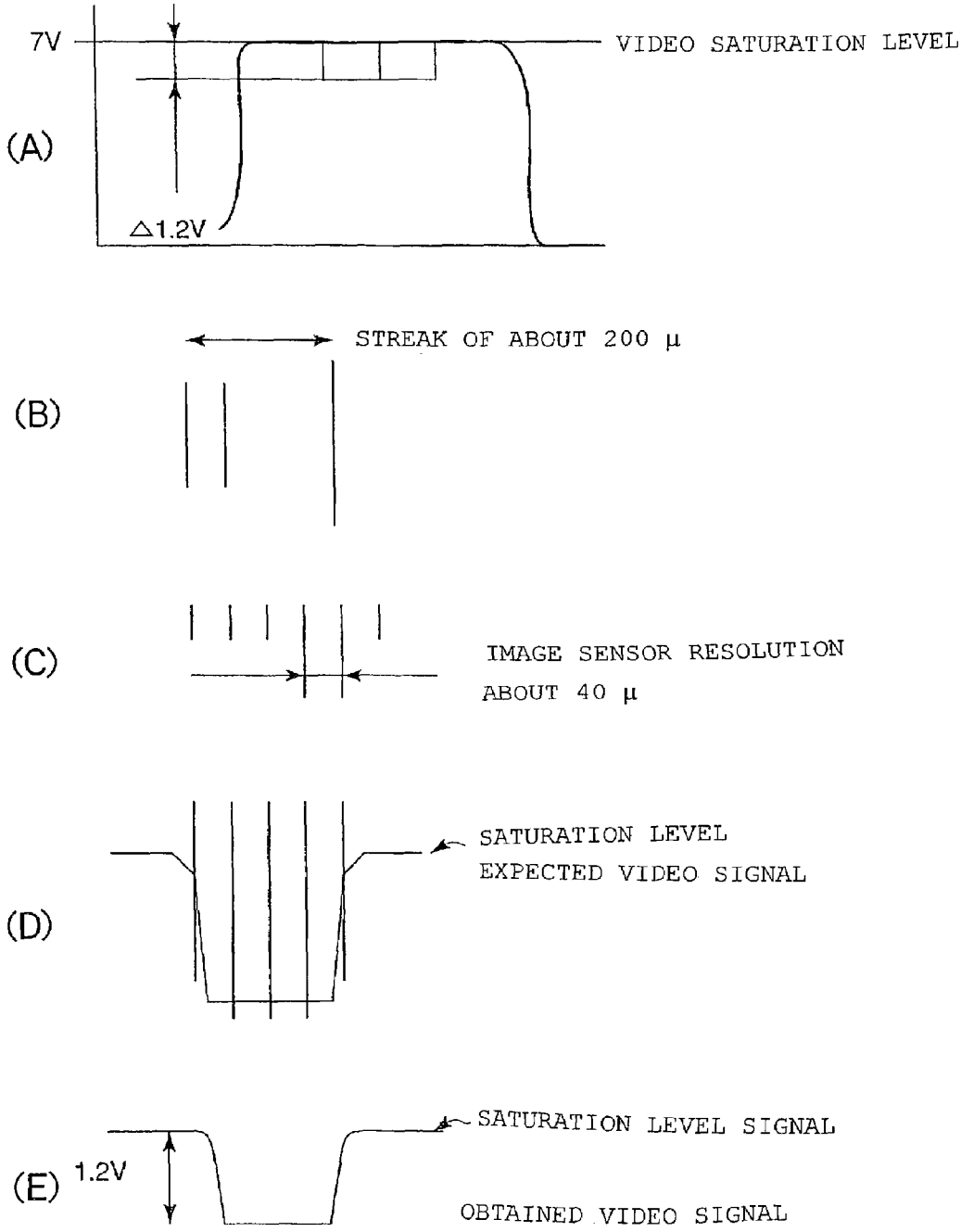
FIGS. 44A to 44E are explanatory diagrams showing the operation of an inspection device for a recycle developer bearing body according to Embodiment 1 of the present invention.

A sensor of the line camera 10 is short with respect to the length of the developing sleeve 48 and this makes the line camera 104 a reduction optical system. Therefore, Point B which is at the center of the developing sleeve 48 is different in intensity of light reflected at the surface of the developing sleeve from Point A and Point C which are at the ends of the developing sleeve. As shown in FIG. 42, the intensity of reflected light is high at Point B at the center of the developing sleeve 48 where the light path is short and the angle of reflection is small while the intensity of reflected light is low at Point A and Point C at the ends of the developing sleeve where the light path is long and the angle reflection is large. The difference in intensity of reflected light between Center Point B and End Points A and C is large and, as shown in FIG. 42C, it lowers the dynamic range which is determined by the difference between output values LV1 and LV2 of the line camera 104. This makes it difficult to detect a scar, stain, or other defect on the surface of the developing sleeve 48 from an output value of the line camera 104. To remedy this, the dynamic range is made higher by subjecting an output value of the line camera 104 to shading correction treatment.

Therefore, a contact line sensor 106 (contact image sensor) is preferred as the inspection device 105 for the recycle developer bearing body to detect light reflected at the surface of the developing sleeve 48 as shown in FIG. 43A. In the inspection device, which is denoted by 105, the contact line sensor 106 is in parallel to the axial direction of the developing sleeve 48 at a close distance from the surface of the developing sleeve 48. This makes it possible for the sensor to receive reflected light which travels along the axial direction of the developing sleeve 48 for a very short light path without being influenced by disturbance, and the usable dynamic range of the line sensor 106 is widened. The contact line sensor 106 emits light from an LED array 107 in which LEDs are lined up facing the surface of the developing sleeve 48 to serve as a light radiating unit. The emitted light is reflected at the surface of the developing sleeve 48, and the reflected light is led through a rod array lens 108 to an image sensor 109 (light receiving unit) in which light receiving elements such as phototransistors, photodiodes, or CCDs are arranged into a straight line. Signals outputted from the image sensor 109 are sequentially sent forward by a built-in shift register, and are obtained as serial video signals outputted in time-series along the longitudinal direction of the image sensor 109 as shown in FIG. 43B.

The image sensor 109 used has a resolution of, for example, 600 BPI to 1200 BPI. As shown in FIGS. 44A to 44E, the resolution of the image sensor 109 is set to about 40 $\mu$m if the surface of the developing sleeve 48 has a streak-like scar with a width of 200 $\mu$m, for example. When the developing sleeve 48 has a scar on its surface, the image sensor 109 is set such that the output level of a signal from the scar is about 1.2 V lower than the level of a saturation level signal.

Figure 45:
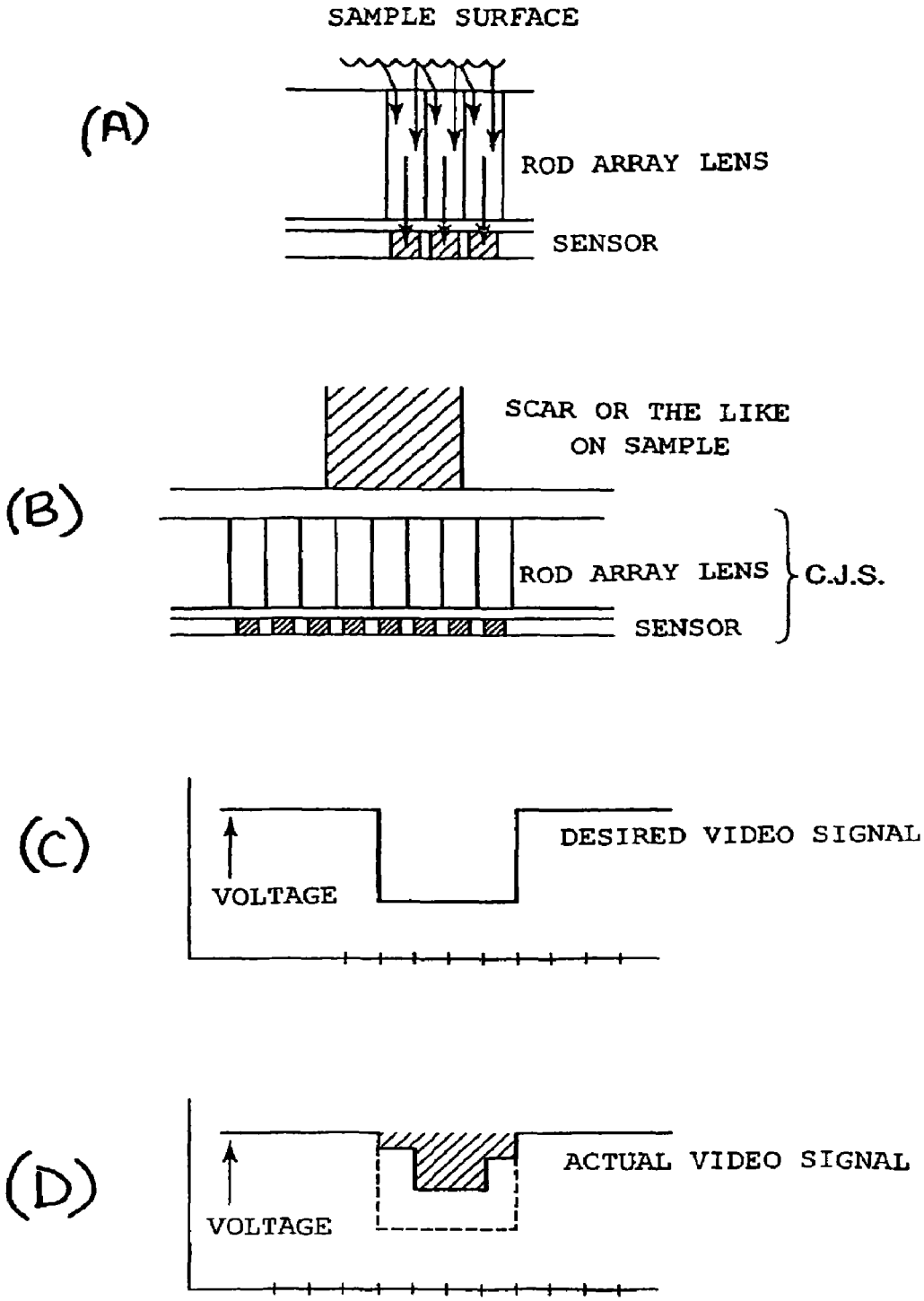
FIGS. 45A to 45D are explanatory diagrams showing the operation of an inspection device for a recycle developer bearing body according to Embodiment 1 of the present invention.

If the developing sleeve 48 of the developing roll 27 has a lustered surface, the surface of the developing sleeve 48 has high reflectivity and is enhanced in ability to feed toner. Therefore, if there are fine surface irregularities, light is scattered in the vicinity of a scar, stain, or other defect. When light is scattered in the vicinity of a scar, stain, or other defect on the surface of the developing sleeve 48, scattered light enters the line sensor 106 as shown in FIG. 45A and the detection level of the line sensor 106 is seemingly raised to make detection of the scar or other defect difficult.

To counter this, the seeming rise in detection level of the line sensor 106 is restricted to a certain degree by interposing a polarization filter 110 between the line sensor 106 and the developing sleeve 48 as shown in FIG. 46A to prevent light scattered near a scar, stain, or other defect from entering the line sensor 106.

High reflectivity of the surface of the developing sleeve brings about another problem; the intensity of reflected light is greatly varied depending on, for example, the color or dullness of the surface of the developing sleeve, there by making it difficult to discern a defect such as a scar or a stain.

Figure 47:
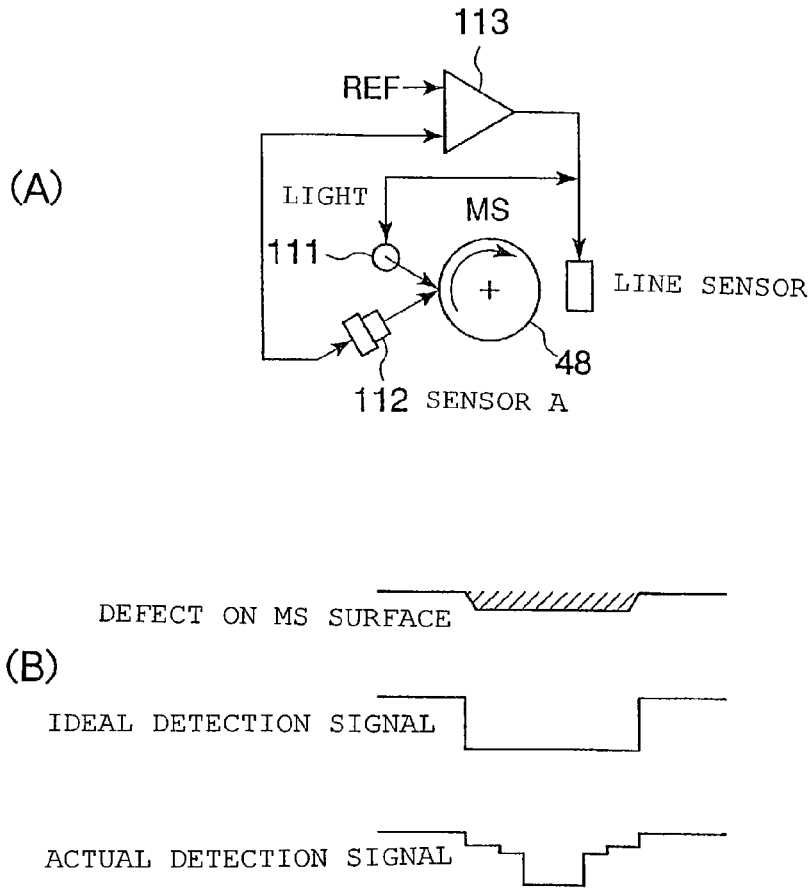
FIGS. 47A and 47B are explanatory diagrams showing the operation of an inspection device for a recycle developer bearing body according to Embodiment 1 of the present invention.

As described, luster on the surface of the developing sleeve 48 can greatly vary the intensity of reflected light depending on, for example, the color or dullness of the surface of the developing sleeve. To counter this, the output of the line sensor 106 is kept substantially constant in a manner shown in FIGS. 47A and 47B. In FIGS. 47A and 47B, another light source 111 is used to irradiate the surface of the developing sleeve 48 with light, reflected light from the surface of the developing sleeve 48 is detected by a light receiving sensor 112 which serves as a detection unit, an output of the light receiving sensor 112 is compared with a given value REF by a differential amplifier 113, and the light amount of the LED array 107 of the line sensor 106 is controlled by an output of the differential amplifier 113 such that the output of the light receiving sensor 112 is made equal to the given value REF. As a result, the dynamic range of the line sensor 106 can be used effectively to detect a scar or other defect on the surface of the developing sleeve 48 irrespective of the color or dullness of the surface of the developing sleeve 48.

Figure 48:
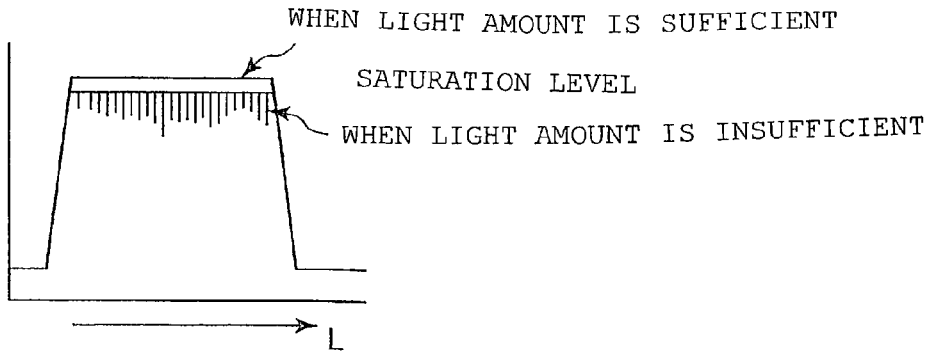
FIG. 48 is an explanatory diagram showing an inspection device for a recycle developer bearing body according to Embodiment 1 of the present invention.

In this case, in order to keep the line sensor output constant for a normal developing sleeve 48, it is effective to saturate the output of the line sensor 106 by setting the intensity of light emitted from the LED array 107 a little higher than usual as shown in FIG. 48. This makes a change in output of the line sensor greater beyond a certain point when reflected light is changed greatly by a scar or the like on the surface of the developing sleeve while slight irregularities on the surface of the developing sleeve hardly cause a change in light reflected at the surface of the developing sleeve 48. Therefore, a scar or the like can be detected more certainly and the dynamic range of the comparator can be widened. The same effect can be obtained by putting the output of the line sensor 106 through a limiter.

Next, a specific structure of the inspection device for a recycle developer bearing body is described.

Figure 49:
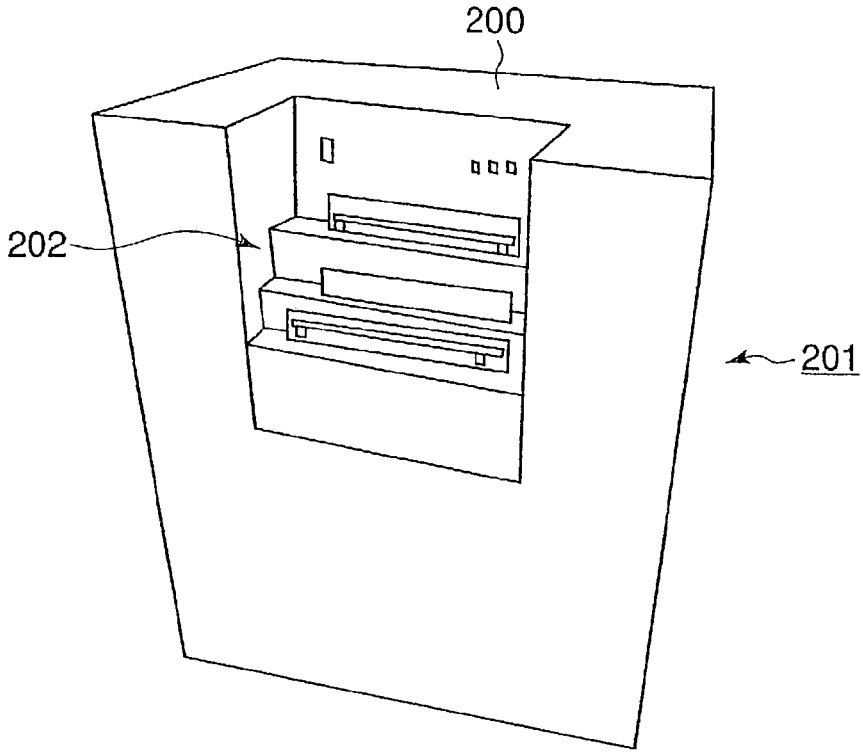
FIG. 49 is an exterior perspective view of an inspection device for a recycle developer bearing body according to Embodiment 1 of the present invention.
Figure 50:
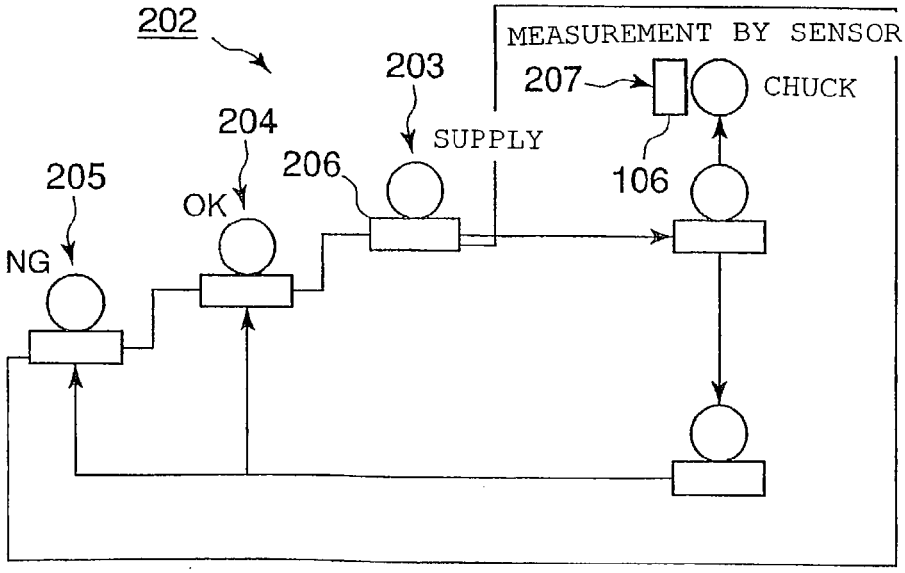
FIG. 50 is a structural diagram showing an inspection device for a recycle developer bearing body according to Embodiment 1 of the present invention.

As shown in FIG. 49, the inspection device 200 for a recycle developer bearing body has a large device casing 201 which is shaped into substantially a cuboid. On the front face of the device casing 201, a work stage 202 is positioned side to side in an upper part. The work stage 202 is substantially stepped as shown in FIG. 50. The top step is a sample loading portion 203 through which the developing roll 27 as a sample is loaded. One step below is an acceptables discharge portion 204 for discharging an acceptable developing roll which is found out through the inspection to have no scar or other defect that exceeds a given degree on its surface. The bottom step is a rejects discharge portion 205 for discharging a rejected developing roll which is found out through the inspection to have a scar or other defect that exceeds a given degree on its surface.

The sample loading portion 203 has as shown in FIG. 50 preset bases 206 each of which holds ends of the developing roll 27 and is movable in the horizontal direction and the vertical direction. The preset bases 206 are moved one at a time by a not-shown moving unit in the horizontal direction toward the interior of the device casing 201, and then the developing roll 27 alone is raised toward an inspection portion 207. The preset bases 206 of the sample loading portion 203 are moved one by one. As the developing roll 27 on one of the preset bases 206 is moved to the inspection portion, the next preset base is moved to the sample loading portion 203 to receive the next developing roll 27. The loading portion is thus structured to enhance the work efficiency.

As the developing roll 27 arrives at the inspection portion 207, a right-hand chuck 208 is moved by a pusher 209 and the right-hand chuck 208 and a left-hand chuck 209 are attached to the right and left ends of the developing roll 27, respectively, as shown in FIGS. 51A and 51B. The left-hand chuck 210 is driven rotationally through a pulse motor 211 and through a drive pulley 211 and a drive belt 213. The developing roll 27 is thus rotated to allow the inspection portion 207 to examine the entire circumference of the developing roll 27. The pulse motor 211 is driven by a pulse generator 214, which is connected to a video circuit 215 and is controlled by a pulse motor control 216 in accordance with command from a CPU 217.

Once the surface of the developing roll 27 is inspected for a scar or the like in the inspection portion 207, the developing roll is moved downward and is set on one of the preset bases 206 that is waiting as shown in FIG. 50. Then, if the inspection result tells the developing roll 27 is acceptable, the developing roll is transported to the acceptables discharge portion 204 by a not-shown moving unit and is discharged from there. If the inspection result tells the developing roll 27 is rejected, the developing roll is transported to the rejects discharge portion 205 by a not-shown moving unit and is discharged from there.

As shown in FIG. 49, the inspection device 200 for a recycle developer bearing body may have an OK lamp lit to indicate that a developing roll inspected is acceptable and in accordance with the inspection result, an NG lamp is lit to indicate that a developing roll inspected is rejected. Denoted by reference numerals 218 and 219 in FIG. 49 are a start switch and an eject switch, respectively.

In the inspection device 200 for a recycle developer bearing body, the surface state of the developing roll 27 is inspected by the inspection portion 207 and then an output signal from the line sensor 106 is sent to a judging portion. The judging portion, which is denoted by reference numeral 220, automatically discerns whether or not the developing roll inspected is acceptable or to be rejected.

Figure 52:
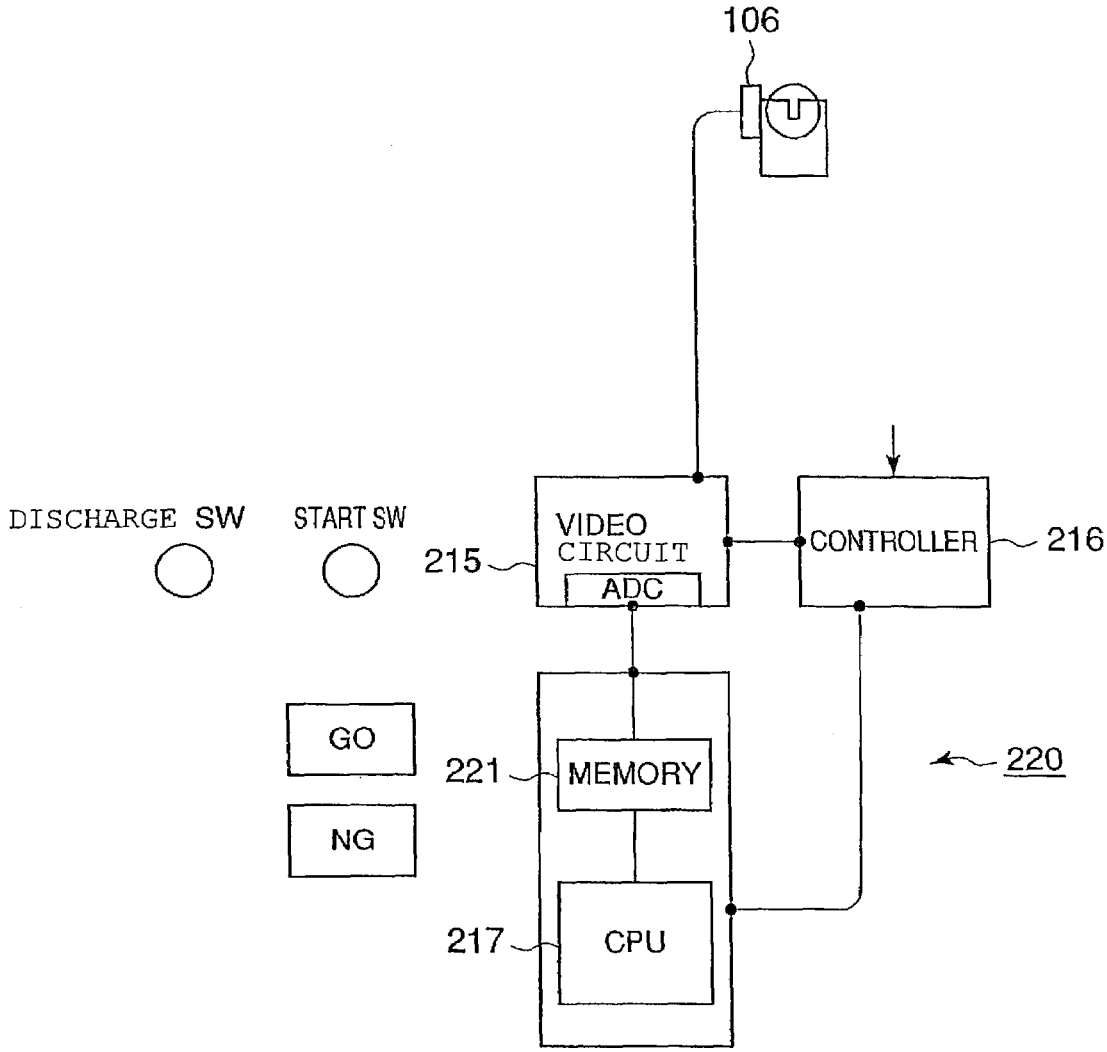
FIG. 52 is a block diagram showing an inspection device for a recycle developer bearing body according to Embodiment 1 of the present invention.

The judging portion 220 has as shown in FIG. 52 the video circuit 215 that is connected to the line sensor 106, and has a memory 221 for storing video signals outputted from the video circuit 215. The judging portion 220 also has the CPU 217 for discerning whether the developing roll 27 inspected is acceptable or to be rejected, the pulse motor control 216, and an I/O interface 223 that is connected to an operation panel 222. For example, a personal computer with a given inspection program stored therein is used as the judging portion 220.

In the thus structured inspection device 200 for a recycle developer bearing body, the developing roll 27 as a sample is set on one of the present bases 206 located in the sample loading portion 203 and a start button is depressed as shown in FIGS. 49 and 50. Then the developing roll 27 set on one of the preset bases 206 is moved to the inspection portion 207, where the surface of the developing roll is examined for a scar or other defect. While one developing roll 27 is inspected, the next developing roll 27 can be set on another one of the preset bases 206 at the sample loading portion 203.

As the eject switch of the above inspection device 200 is depressed, the developing roll 27 after the inspection is discharged from the acceptables discharge portion 204 or the rejects discharge portion 205 depending on the result of the judgment. At the same time, a large-sized GO or NG indicator is lit to indicate the judgment result. The indicator is put off when inspection of the next developing roll is finished, and is again lit as this developing roll 27 is discharged.

As shown in FIGS. 51A and 51B, the developing roll 27 is inspected by rotating the developing roll 27, detecting light reflected at the surface of the developing roll 27 by the line sensor 106, plotting video signals from the line sensor 106 on a map on the memory, and processing the video signals.

The discerning processing for a defect such as a scar or a stain on the surface of the developing roll 27 is carried out as follows:

1) Obvious Scar and Stain (Comparate Processing)

When there is an obvious scar, stain, or other defect on the surface of the developing roll 27 as shown in FIG. 53A, a video signal obtained from the line sensor 106 greatly drops as shown in FIG. 53B at a position where the obvious scar, stain, or other defect is located. Therefore, an obvious scar, stain, or other defect on the surface of the developing roll 27 can be discerned from whether or not the output of the comparator 224 becomes high (H) in a corresponding region of the surface of the developing roll 27 by comparing the output of the line sensor 106 to a certain standard value REF using the comparator 224. In practice, a video signal from the line sensor 106 is subjected to AD conversion and the resultant digital value is compared by the comparator.

2) Spotty Defect (Area Integration Processing)

Figure 54:
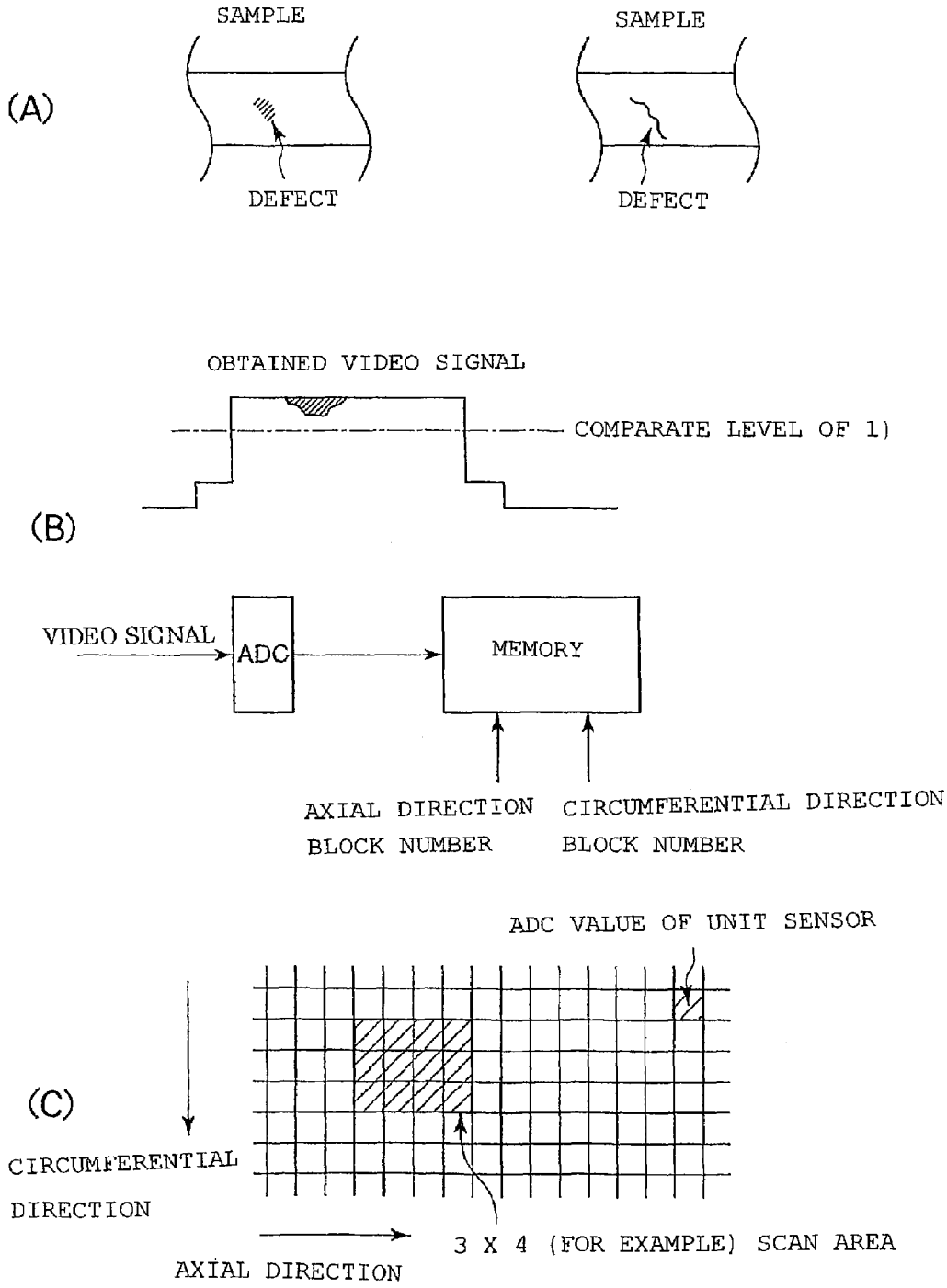
FIGS. 54A to 54C are explanatory diagrams showing the operation of an inspection device for a recycle developer bearing body according to Embodiment 1 of the present invention.

When the surface of the developing roll 27 has a spotty defect such as a stain having a considerable area or a scar running along the axial direction as shown in FIG. 54A, video signals obtained from the line sensor 106 are plotted on a map on the memory 221 as shown in FIG. 54B. Then a small area, a 3×4 scan area, for example, is set to scan the surface while shifting the scan area one dot at a time in the axial direction and the circumferential direction. The obtained integration value is used to judge the defect. For instance, the number of dots in the 3×4 scan area at which the intensity of reflected light is lowered by a spotty defect is counted and, if the count exceeds a given number, it is judged that the region has a spotty defect.

3) Small Continuous Scar Running along the Circumference (Circumferential Direction Integration Processing)

Figure 55:
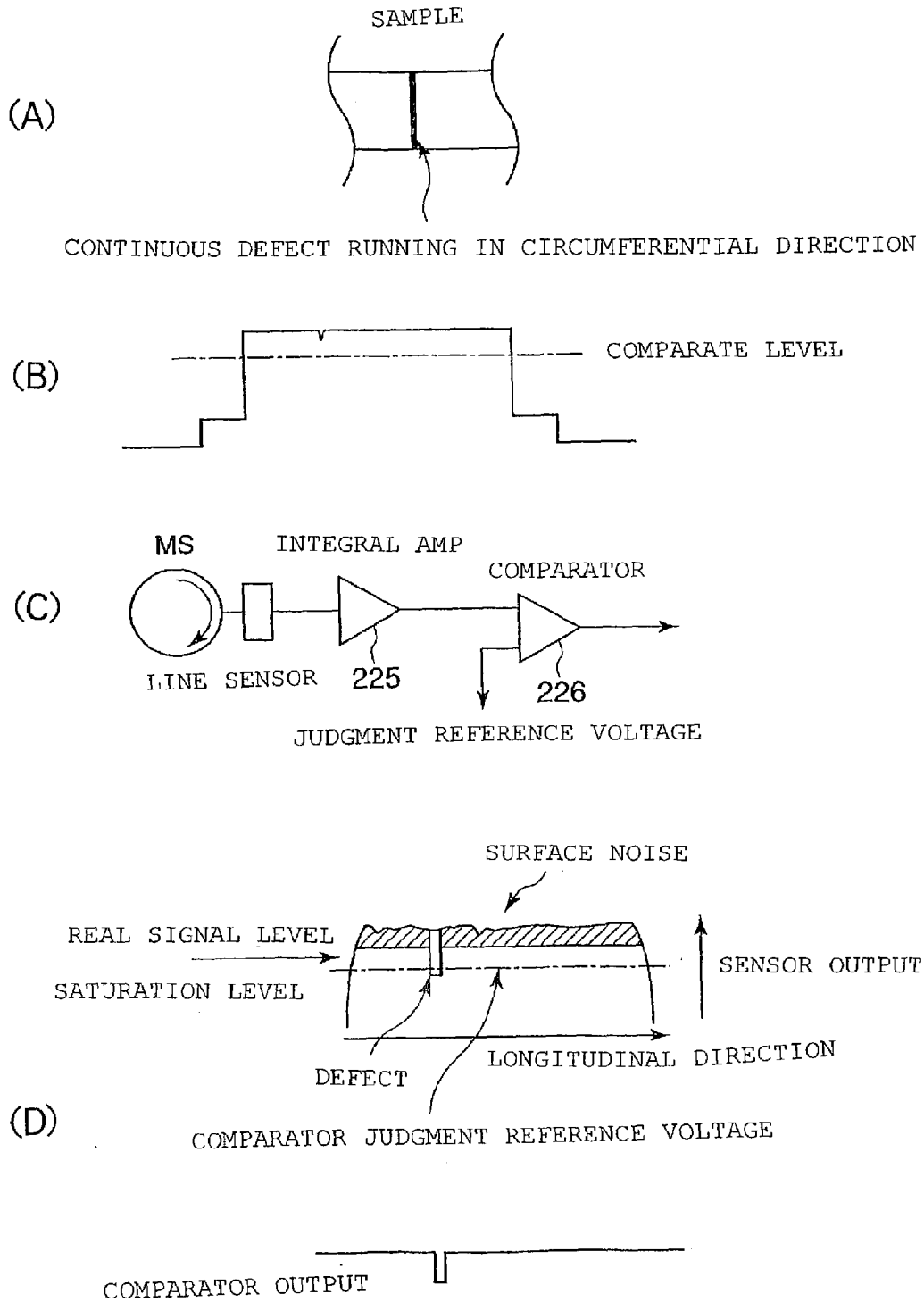
FIGS. 55A to 55D are explanatory diagrams showing the operation of an inspection device for a recycle developer bearing body according to Embodiment 1 of the present invention.

When a defect on the surface of the developing roll 27 is a narrow, small, continuous scar running along the circumference as shown in FIG. 55A, the developing roll 27 is rotated and video signals obtained from the line sensor 106 are integrated along the entire circumference by an integration amplifier 225. The comparator 226 compares the obtained integration value to a set value. This method prevents a continuous scar which runs along the circumference from being overlooked even when the scar is narrow and small.

In the above inspection device 200, it is desirable to process video signals by normalizing the output of the image sensor 109 and then comparating at a given level for binarization. When plotting the output of the image sensor 109 on a map on the memory, an isolate point is removed as noise to thereby improve the detection accuracy. If there are several regions having the defects 102 such as a continuous scar, the regions having the defects 102 such as a continuous scar are desirably labeled by giving a number or a symbol to each when plotting the output of the image sensor 109 on a map on the memory. The regions having the defects 102 such as a continuous scar are thus distinguished from one another. As described above, the scar or other defects 102 on the developing sleeve 46 are often continuous scars which run in the circumferential direction. Therefore, a streak-like scar along the circumference can be distinguished from other types of scars or defects by calculating the continuity in the circumferential direction of the scar or other defects 102.

As has been described, according to the above embodiment, the used developing roll 27 can be reused effectively to help effective utilization of resources while avoiding image quality degradation such as developer concentration unevenness.

Furthermore, the above description proves that no image quality problem arises from reuse of the developing roll 27 that has a scar on its surface from previous use in printing at least 72000 sheets, which corresponds to twice the life span of the process cartridge 2, as long as the width and surface roughness of the scar are within given ranges.

What is claimed is:

1. A recycle developer bearing body, comprising:

a used developer bearing body that is reusable without being resurfaced;

wherein the used developer bearing body has one or more scars on a developer bearing surface of the developer bearing body from a previous use, and a surface roughness Ra of the developer bearing surface including the scars is about 0.8 $\mu$m or more, and is about 2.3 $\mu$m or less.

2. A recycle developer bearing body according to claim 1, wherein the surface roughness Ra on the developer bearing surface of the developer bearing body is set to about 0.9 to 2.3 $\mu$m when the developer bearing body is new.

3. A recycle developer bearing body according to claim 1, wherein the surface of the developer bearing body is irradiated with light to inspect the bearing body for reuse, the intensity of light reflected by the developer bearing body is detected by a light receiving unit, and a scar on the developer bearing surface of the developer bearing body is automatically discerned based on an output signal from the light receiving unit.

4. A recycle developer bearing body according to claim 1, wherein the developer bearing body is recycled by a recycling method comprising:

removing plastic parts from the used developer bearing body;

cleaning the used developer bearing body from which the plastic parts are removed;

irradiating the surface of the developer bearing body which is cleaned in the cleaning step with light;

detecting an intensity of light reflected by the developer bearing body using a light receiving unit;

discerning the surface state of the developer bearing body regarding a scar or other defect based on an output signal from the light receiving unit automatically;

removing toner that adheres to portions of the developer bearing body which has undergone the discerning step, the portions being in the vicinity of ends in the axial direction of the developer bearing body; and attaching new plastic parts to the developer bearing body from which the toner is removed in the adhering toner removing step.

5. The recycling method according to claim 4, further comprising:

marking the developer bearing body to which the plastic parts are attached to indicate that the developer bearing body is a recycled product.

6. A recycle developer bearing body, comprising:

a used developer bearing body that is reusable without being resurfaced;

wherein the used developer bearing body has a plurality of scars on a developer bearing surface of the developer bearing body from a previous use and a surface roughness Ra of about 0.8 $\mu$m or more, and wherein a width in an axial direction of each of the scars is about 0.3 mm or less.

7. A recycle developer bearing body, comprising:

a used developer bearing body;

wherein scars on a developer bearing surface of the developer bearing body from a previous use have a surface roughness Ra of about 0.8 $\mu$m or more, and wherein a distance between a center in an axial direction of one of the scars and a center in an axial direction of an adjacent scar is about 5 mm or more.

8. A method of recycling a used developer bearing body for recovering a used developer bearing body for reuse, comprising:

removing plastic parts from the used and recovered developer bearing body;

cleaning the used developer bearing body from which the plastic parts are removed;

irradiating with light a surface of the developer bearing body which is cleaned in the cleaning step, using a light receiving unit to detect the intensity of light reflected by the developer bearing body, and automatically discerning the surface state of the developer bearing body regarding a scar or other defect based on an output signal from the light receiving unit;

removing toner that adheres to portions of the developer bearing body which has undergone the discerning step, the portions being in the vicinity of ends in the axial direction of the developer bearing body;

attaching new plastic parts to the developer bearing body from which the toner is removed in the adhering toner removing step; and marking the developer bearing body to which the plastic parts are attached to indicate that the developer bearing body is a recycled product.

9. A method of recycling a used process cartridge having a developer bearing body, comprising:

disassembling the used process cartridge and removing the developer bearing body;

cleaning the developer bearing body;

determining a surface roughness Ra of the developer bearing body resulting from scarring during a previous use as being about 0.8 μm or more; and re-assembling the process cartridge using the developer bearing body without resurfacing the developer bearing body.

10. A method of recycling a used process cartridge including a developer bearing body having scars, comprising:

disassembling the used process cartridge and removing the developer bearing body;

cleaning the developer bearing body;

determining a surface roughness Ra of the developer bearing body resulting from scarring during a previous use as being about 0.8 μm or more and a width in an axial direction of each of the scars being 0.3 mm or less; and re-assembling the process cartridge using the developer bearing body.

11. A method of recycling a used process cartridge including a developer bearing body having scars or defects, comprising:

disassembling the used process cartridge and removing the developer bearing body;

cleaning the developer bearing body;

determining a surface roughness Ra of the developer bearing body resulting from scarring during a previous use as being about 0.8 μm or more and a distance between a center in an axial direction of one of the scars and a center in an axial direction of its adjacent scar is about 5 mm or more; and re-assembling the process cartridge using the developer bearing body without resurfacing the developer bearing body.

* * * * *